US011204201B2

(12) United States Patent
Singh

(10) Patent No.: US 11,204,201 B2
(45) Date of Patent: Dec. 21, 2021

(54) AIR-COOLED CONDENSER SYSTEM

(71) Applicant: HOLTEC INTERNATIONAL, Camden, NJ (US)

(72) Inventor: Krishna P. Singh, Hobe Sound, FL (US)

(73) Assignee: HOLTEC INTERNATIONAL

( * ) Notice: Subject to any disclaimer, the term of this patent is extended or adjusted under 35 U.S.C. 154(b) by 347 days.

(21) Appl. No.: 16/142,246

(22) Filed: Sep. 26, 2018

(65) Prior Publication Data

US 2019/0093953 A1 Mar. 28, 2019

Related U.S. Application Data

(60) Provisional application No. 62/564,000, filed on Sep. 27, 2017.

(51) Int. Cl.
*F28D 1/053* (2006.01)
*F28F 19/02* (2006.01)
(Continued)

(52) U.S. Cl.
CPC ..... *F28D 1/05308* (2013.01); *F28B 1/06* (2013.01); *F28F 19/02* (2013.01); *F28D 1/024* (2013.01);
(Continued)

(58) Field of Classification Search
CPC ..... F28D 2011/0266; F28D 1/0426; F28D 1/05366; F28D 1/05358; F28D 1/024;
(Continued)

(56) References Cited

U.S. PATENT DOCUMENTS 3,716,097 A * 2/1973 Kelp ..... F28B 1/06 165/299
5,490,559 A * 2/1996 Dinulescu ..... F28B 1/06 165/148
(Continued)

FOREIGN PATENT DOCUMENTS

CA 2081695 9/1993
DE 102006029773 7/2007
(Continued)

OTHER PUBLICATIONS

International Search Report and Written Opinion for International Application No. PCT/US2020/038662 dated Sep. 8, 2020.
(Continued)

*Primary Examiner* — Joel M Attey
*Assistant Examiner* — For K Ling
(74) *Attorney, Agent, or Firm* — The Belles Group, P.C.

(57) ABSTRACT

An air-cooled condenser system for steam condensing applications in a power plant Rankine cycle includes an air cooled condenser having a plurality of interconnected modular cooling cells. Each cell comprises a frame-supported fan, inlet steam header, outlet condensate headers, and tube bundle assemblies having optionally finned tubes extending between the headers. The tube bundle assemblies may fabricated into an A-shaped tube structure. The tube bundles are self-supporting without support from any part of the frame between top and bottom tubesheets of each bundle. The condensate headers may be slideably mounted to the frame for thermal expansion/contraction. Steam circulating in a closed flow loop on the tube side from a steam turbine is cooled in each cell by ambient air blown through the tube bundles, thereby forming liquid condensate returned to the Rankine cycle. The present design further provides a longitudinal and vertical thermal expansion restraint system.

28 Claims, 19 Drawing Sheets

(51) Int. Cl.
*F28B 1/06* (2006.01)
*F28D 1/02* (2006.01)
*F28D 21/00* (2006.01)

(52) U.S. Cl.
CPC ..... *F28D 1/05358* (2013.01); *F28D 1/05366* (2013.01); *F28D 2021/0063* (2013.01); *F28F 2265/26* (2013.01); *F28F 2280/00* (2013.01)

(58) Field of Classification Search
CPC ..... F28D 1/05308; F28D 2021/0063; F28F 9/013; F28F 9/0131; F28F 9/007; F28F 2265/26; F28F 19/02; F28F 2280/00; B01D 5/0012; F16L 3/18; F16L 3/26; F16L 3/01; F16L 3/237; F16L 3/20; F28B 1/06; F28B 1/08; F28B 1/02; F25B 39/04
See application file for complete search history.

(56) References Cited

U.S. PATENT DOCUMENTS

| | | | | |
|---|---|---|---|---|
| 6,474,272 | B2 * | 11/2002 | Bensing | B01D 5/0012 122/459 |
| 6,691,742 | B1 * | 2/2004 | Cooper | F16L 3/14 138/106 |
| 8,297,561 | B1 | 10/2012 | Montplaisir et al. | |
| 9,951,994 | B2 | 4/2018 | Vouche et al. | |
| 10,024,600 | B2 | 7/2018 | Bugler et al. | |
| 2002/0005176 | A1 | 1/2002 | Bensing et al. | |
| 2009/0178279 | A1 * | 7/2009 | Schabosky | F28F 9/002 29/890.07 |
| 2010/0078147 | A1 | 4/2010 | Samyn et al. | |
| 2013/0263840 | A1 | 10/2013 | Maeda | |
| 2013/0292103 | A1 * | 11/2013 | Eindhoven | B23P 15/26 165/173 |
| 2014/0367243 | A1 | 12/2014 | Kroger et al. | |
| 2015/0345166 | A1 | 12/2015 | Quickelberghe et al. | |
| 2017/0051981 | A1 | 2/2017 | Singh et al. | |
| 2017/0130872 | A1 * | 5/2017 | Drummond | F16L 3/18 |
| 2018/0100700 | A1 | 4/2018 | Beaver et al. | |
| 2019/0093953 | A1 | 3/2019 | Singh et al. | |

FOREIGN PATENT DOCUMENTS

| | | | | |
|---|---|---|---|---|
| DE | 10 2014 112 707 A1 | 9/2014 | | |
| DE | 102014112707 | 3/2016 | | |
| JP | 61082035 A * | 4/1986 | | F16F 7/08 |

OTHER PUBLICATIONS

The Extended European Search Report, Application No. EP 18861811 dated May 25, 2021.

* cited by examiner

AIR-COOLED CONDENSER SYSTEM

CROSS-REFERENCE TO RELATED APPLICATIONS

The present application claims the benefit of priority to U.S. Provisional Application No. 62/564,000 filed Sep. 27, 2017; the entirety of which is incorporated herein by reference.

BACKGROUND

The present invention generally relates to dry cooling systems, and more particularly to an air-cooled condenser system suitable for steam condensing applications in a Rankine cycle of an electric generating power plant or other non-power generating applications.

An air-cooled condenser (ACC) provides a competent alternative to the water-cooled condenser to condense large quantities of low pressure waste steam from power plants and other industrial installations. Over the past seven decades, the state-of-the art in ACC design has evolved to the single tube row configuration wherein a blower blasts ambient air past an array of inclined finned tubes that emulate a pitched A-frame roof. The angle of inclination of the finned tubes is typically 60 degrees from the horizontal plane. The finned tubes are in the shape of an elongated obround tube with the flat surfaces equipped with tall aluminum fins through which the blower's forced air must traverse to exit the ACC. The above arrangement of the blower and the finned tube bundles for efficient heat transfer is an established and proven technology that is widely used in ACC design. However, it is their structural design and constructability aspects of present and installation design practice that are amenable to innovation.

To frame the structural problem and put things in perspective, it is important to recognize that an ACC is a large massive structure. For a 500 MWe power plant, for example, a typical ACC has a footprint of about 40,000 square feet and rises about 110 feet high. The inclined tube bundles are each attached directly to and fully supported by a structural A-frame, which in turn is supported by a vertically-extending superstructure which elevates the fan and tube bundles above the ground. The heat transfer function of the ACC means that the tube bundles and piping headers of the structure undergoes significant thermal expansion and contraction under the ACC's normal operating conditions. Erecting a large ACC structure on site, particularly building the structural A-frame required to support the tube bundles, requires a significant amount of time and human effort.

An improved air-cooled condenser is therefore desired which minimizes the structural work required on site for erection and concomitantly provides thermal expansion/contraction capabilities to prevent differential thermal expansion induced crack formation particularly of the fluid components which form the pressure boundary for the steam and condensate.

SUMMARY

An air-cooled condenser (ACC) system according to the present disclosure provides a novel configuration and support system which overcomes the foregoing disadvantages of prior ACC design. The ACC system may include an ACC comprising a top common steam header and a pair of laterally spaced apart bottom condensate headers. The ACC may be a single row finned tube heat exchanger comprising a plurality of inclined and self-supporting planar tube bundles arranged in an A-shape tube construction or structure in one configuration. An acute angle is formed between opposing walls or panels of tube bundles. In contrast to prior ACC design, the present ACC advantageously does not require a structural A-frame to support the tube bundles. The present design instead leverages the strength of the angled tube bundle panels by providing a unique coupling at the top joint between upper tubesheets of the panels to hingedly couple the panels together which accommodates differential thermal expansion of the tube bundles. In embodiment, the hinge may be formed by an angled seal plate sealably attached to each tubesheet.

In addition, a unique lower support system for the tube bundles provides unfixed and slideable mounting of the condensate headers to which each tube bundle is coupled. This allows the headers (steam and condensate) and tube bundles to grow or contract in the longitudinal direction as a unit thereby negating any significant differential thermal expansion problems.

Each tube bundle is fluidly coupled to the steam header at top and one of the condensate headers at bottom. One or more fans arranged below the A-shaped tube bundles blow ambient cooling air through the tube bundles to condense steam flowing through the tube side of the tubes. The condensed steam (i.e. condensate) collects in the bottom condensate headers. In one implementation, the ACC may be fluidly connected to a Rankine cycle flow loop comprising a steam turbine and performs the duty of a surface condenser. The ACC receives exhaust steam from the steam turbine, which is cooled and condensed before being returned to the Rankine cycle flow loop.

In one embodiment, the ACC may further include a thermal restraint unit which is configured to provide both a longitudinal and vertical restraint feature to arrest growth of the steam header and tube bundles under thermal expansion when heated by steam. The thermal restraint unit may comprise an A-frame in one embodiment fixedly mounted to the fan support frame and spaced apart from the tube bundles. The A-frame is a standalone and self-supporting structure. The thermal restraint unit is configured to provide both longitudinal restraint of the steam header and vertically restraint of the tube bundles when each grow in length due to thermal expansion. In one configuration, the thermal restraint unit includes a longitudinally stationary fixation member fixedly attached to the pair of upper tubesheets (which in turn are structural coupled to the steam header). In one embodiment, the fixation member may be a vertically oriented fixation keel plate. The fixation member is operable to arrest longitudinal growth of the steam header when the steam header grows due to thermal expansion, thereby providing a longitudinal restraint feature. The fixation member may be slideably mounted to the thermal restraint unit via a sliding joint which is configured to allow limited vertical growth and movement of the tube bundles when heated by steam, thereby providing a vertical restraint feature. The fixation member thus moves and down with the upper tubesheets and tube bundles fluidly coupled thereto.

In one aspect, an air-cooled condenser includes: a longitudinal axis; a longitudinally-extending steam header configured for receiving steam from a source of steam; a pair of longitudinally-extending condensate headers positioned below the steam header and spaced laterally apart; a pair of inclined tube bundles each comprising a plurality of tubes connected to an upper tubesheet and a lower tubesheet, the tube bundles disposed at an acute angle to each other; each tube bundle extending between and fluidly coupled to the steam header at top and a different one of the condensate headers at bottom forming an A-shaped tube structure; a fan mounted to a fan support frame and positioned below the tube bundles; wherein the tube structure is self-supporting such that the tube bundles are unsupported by the fan support frame between the upper and lower tubesheets.

In one embodiment, the air-cooled condenser may further include: a top steam flow plenum fluidly coupled between the steam header and the tube bundles, the upper tubesheets of each tube bundle attached to the steam flow plenum which is configured to transfer steam from the steam header to the tube bundles; and a condensate flow plenum fluidly coupled between each condensate header and a respective one of the tube bundles, the lower tubesheet of each tube bundle attached to a respective one of the condensate flow plenums which is configured to transfer condensate from the tube bundles to the condensate headers.

In one embodiment, the upper tubesheets are hingedly connected together by a longitudinally-extending angled seal plate, the seal plate comprising a resiliently flexible metal body operable to expand and contract due to thermal expansion.

In one embodiment, a longitudinally-extending monorail for maintenance of the fan may be provided. The monorail may be suspended overhead from the seal plate in one construction.

In another aspect, an air-cooled condenser includes: a longitudinal axis; a longitudinally-extending steam header configured for receiving steam from a source of steam; a pair of longitudinally-extending condensate headers positioned below the steam header and spaced laterally apart, the steam and condensate headers oriented parallel to each other; a pair of inclined tube bundles each comprising a plurality of tubes connected to an upper tubesheet and a lower tubesheet, the tube bundles disposed at an acute angle to each other; the upper tubesheets being hingedly connected together by a longitudinally-extending angled seal plate, the seal plate comprising a resiliently flexible metal body operable to deform under thermal expansion or contraction; each tube bundle arranged between and in fluid communication with the steam header and a different one of the condensate headers at bottom; a fan arranged for blowing ambient cooling air upwards through the bundles; a fan platform configured to support and raise the fan above a support surface, the fan platform comprising a horizontal fan deck positioned below the tube bundles; wherein the tube bundles, steam header, and condensate headers form a self-supporting tube structure in which the tube bundles are not directly supported by any structural members above the fan deck.

In another aspect, an air-cooled condenser includes: a longitudinal axis; a longitudinally-extending steam header configured for receiving steam from a source of steam; a pair of longitudinally-extending condensate headers positioned below the steam header and spaced laterally apart; a pair of inclined tube bundles each comprising a plurality of tubes connected to an upper tubesheet and a lower tubesheet, the tube bundles disposed at an acute angle to each other; each tube bundle extending between and fluidly coupled to the steam header at top and a different one of the condensate headers at bottom forming an A-shaped tube structure; a fan support frame supporting a fan below the tube bundles; the condensate headers each axially slideably supported by a saddle support fixedly attached to the fan support frame, the saddle supports each comprising an upwardly open arcuately curved support surface which slideably engages the condensate headers; wherein the condensate headers are operable to expand or contract in length in a direction parallel to the longitudinal axis due to thermal expansion or contraction conditions.

BRIEF DESCRIPTION OF THE DRAWINGS

The features of the preferred embodiments will be described with reference to the following drawings where like elements are labeled similarly, and in which.

All drawings are schematic and not necessarily to scale. A reference herein to a figure number herein that may include multiple figures of the same number with different alphabetic suffixes shall be construed as a general reference to all those figures unless specifically noted otherwise.

DETAILED DESCRIPTION

Figure 1:
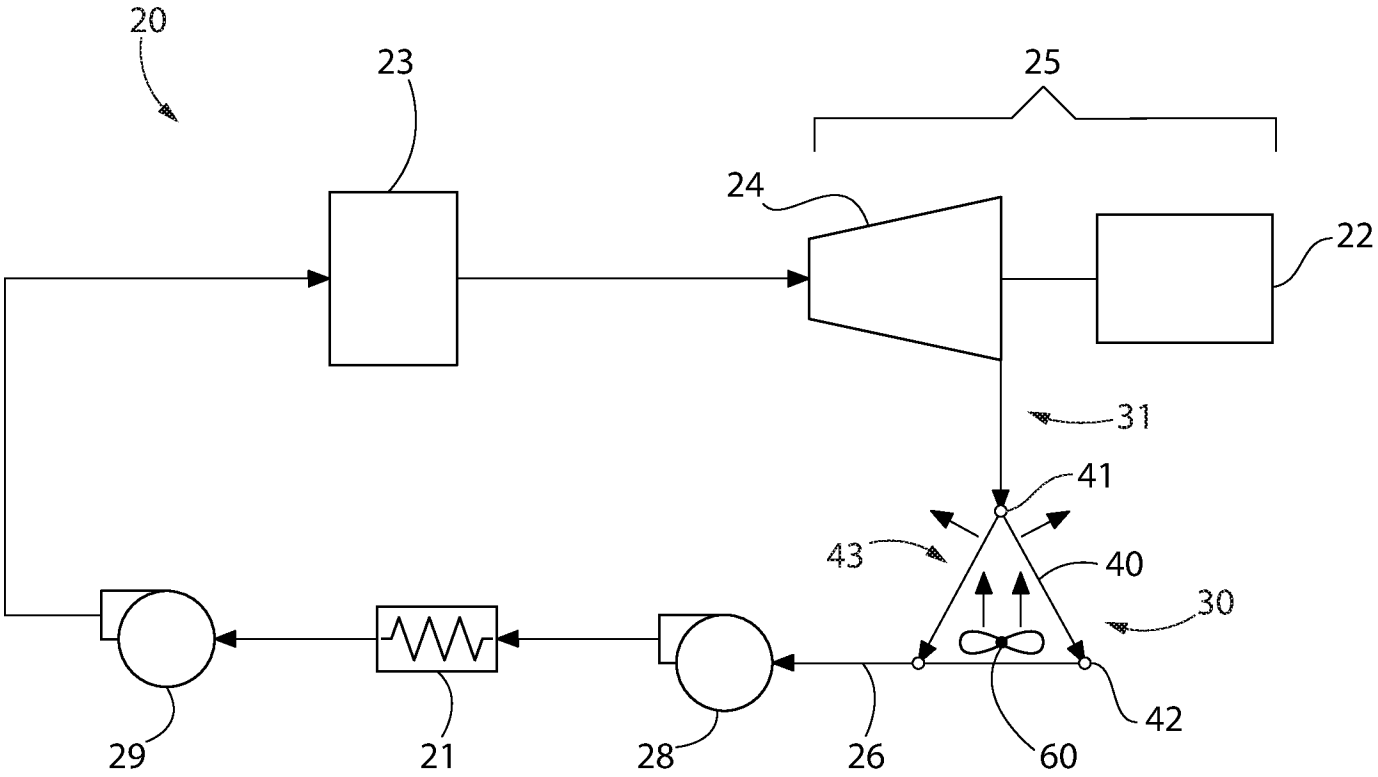
FIG. 1 is a schematic flow diagram of a power generation Rankine cycle comprising an air-cooled condenser (ACC) according to the present disclosure.

The features and benefits of the invention are illustrated and described herein by reference to exemplary ("example") embodiments. This description of exemplary embodiments is intended to be read in connection with the accompanying drawings, which are to be considered part of the entire written description. Accordingly, the disclosure expressly should not be limited to such exemplary embodiments illustrating some possible non-limiting combination of features that may exist alone or in other combinations of features.

In the description of embodiments disclosed herein, any reference to direction or orientation is merely intended for convenience of description and is not intended in any way to limit the scope of the present invention. Relative terms such as "lower," "upper," "horizontal," "vertical,", "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise.

As used throughout, any ranges disclosed herein are used as shorthand for describing each and every value that is within the range. Any value within the range can be selected as the terminus of the range.

The present air-cooled condenser (ACC) is configured and operable to achieve goals of: (a) minimizing the required external support structure around the tube bundles by leveraging the structural strength of the bundle itself, and (b) providing an essentially unrestrained thermal expansion of the tube arrays while imputing the capacity to withstand wind loads and seismic excitation.

In one embodiment, these goals may be accomplished by an ACC design in which the bottom condensate headers (that collect and carry the condensed water cascading down the tubes) are supported in a longitudinally unrestrained manner on curved saddle supports, but are otherwise unconnected. There are no fixed support points associated with the support system for the condensate headers. This arrangement allows the condensate headers and tube bundles to advantageously grow or contract in the longitudinal direction without developing stresses from restraint of thermal expansion or contraction which may induce thermal stress cracking.

The present ACC design further provides a hinged flexible coupling at the junction between the two upper tubesheets of tube bundles at the vertex where they meet at the common steam header. This allows for limited transverse expansion/contraction and vertical growth/contraction of the structure. The flexible joint may comprise a curved or angled seal plate which fluidly and hermetically seals the open joint between the two tubesheets. The angled seal plate also provides ability to absorb lateral expansion to a limited degree. The thermal movement is typically much smaller in the transverse dimension than the vertical direction because of smaller lateral dimensions involved at the tubesheet juncture.

The foregoing aspects of the ACC system are further described below.

FIG. 1 is a schematic flow diagram of a conventional Rankine cycle flow loop 20 of a thermal electric power generation plant. An air-cooled condenser system 30 according to the present disclosure comprising air-cooled condenser (ACC) 40 is fluidly coupled to the Rankine cycle flow loop 20 in a steam condensing application. With additional reference to FIG. 2, ACC 40 generally comprises a top common steam header 41, a pair of bottom condensate headers 42, and pair of inclined/angled tube panels or bundles 43 of generally planar configuration extending between the steam and condensate headers forming an A-frame structure. The power generation plant may be a nuclear plant, fossil fired plant, or utilize another other energy source such as renewables including biomass, trash, or solar in various embodiments. The electric power generating portion of the plant comprises a turbine-generator set 25 including an electric generator 22 and steam turbine 24 operably coupled to the generator for rotating a rotor to generate electricity via stationary stator windings in the generator. A steam generator 23 using a heat or energy source heats feedwater to produce the steam. In various embodiments, the source of heat for the steam generator may be a nuclear reactor, or a furnace which burns a fossil fuel (e.g. coal, oil, shale, natural gas, etc.) or other energy source such as biomass. The heat and fuel source do not limit the invention.

The condensate headers 42 are fluidly connected to condensate return piping 26 to route the liquid condensate back to a condensate return pump 28 which pumps the condensate in flow loop 20 to the steam generator. The condensate is generally pumped through one or more feedwater heaters 21 which uses steam extracted from various stages in the steam turbine 24 to pre-heat the condensate. The pre-heated condensate may be referred to as "feedwater" at this stage in cycle. Feedwater pumps 29 further pressurizes and pumps the feedwater to a steam generator 23) where the liquid feedwater is evaporated and converted into steam. The high pressure steam flows through the steam turbine 24 which in turn produces electricity in a known manner via electric generator 22. The pressure of the steam drops as it progressively flows through the turbine converting thermal and kinetic energy into electric energy. The low pressure steam at the outlet or exhaust of the turbine (i.e. "exhaust steam") is routed to the steam header 41 of the ACC 40 where it condenses and flows back to the Rankine cycle flow loop 20 to complete the flow path. A steam condensing closed flow loop 31 comprising the ACC 40 is thus formed and fluidly coupled to the Rankine cycle flow loop 20 between the steam turbine 24 and condensate pump 28 in this example.

Figure 2:
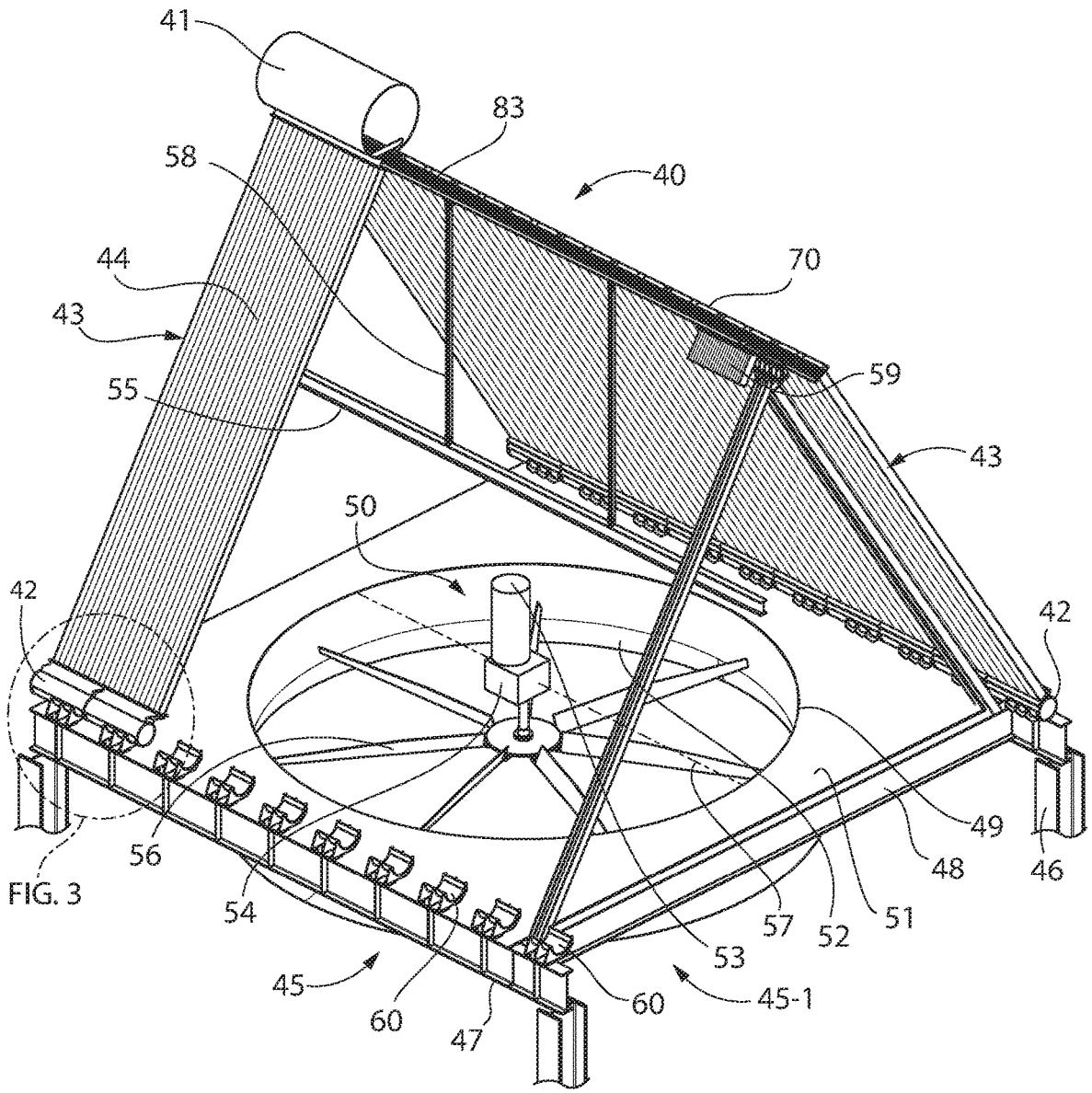
FIG. 2 is a perspective view of the ACC of FIG. 1 with some front tube bundles and structure removed to more clearly show the fan.
Figure 3:
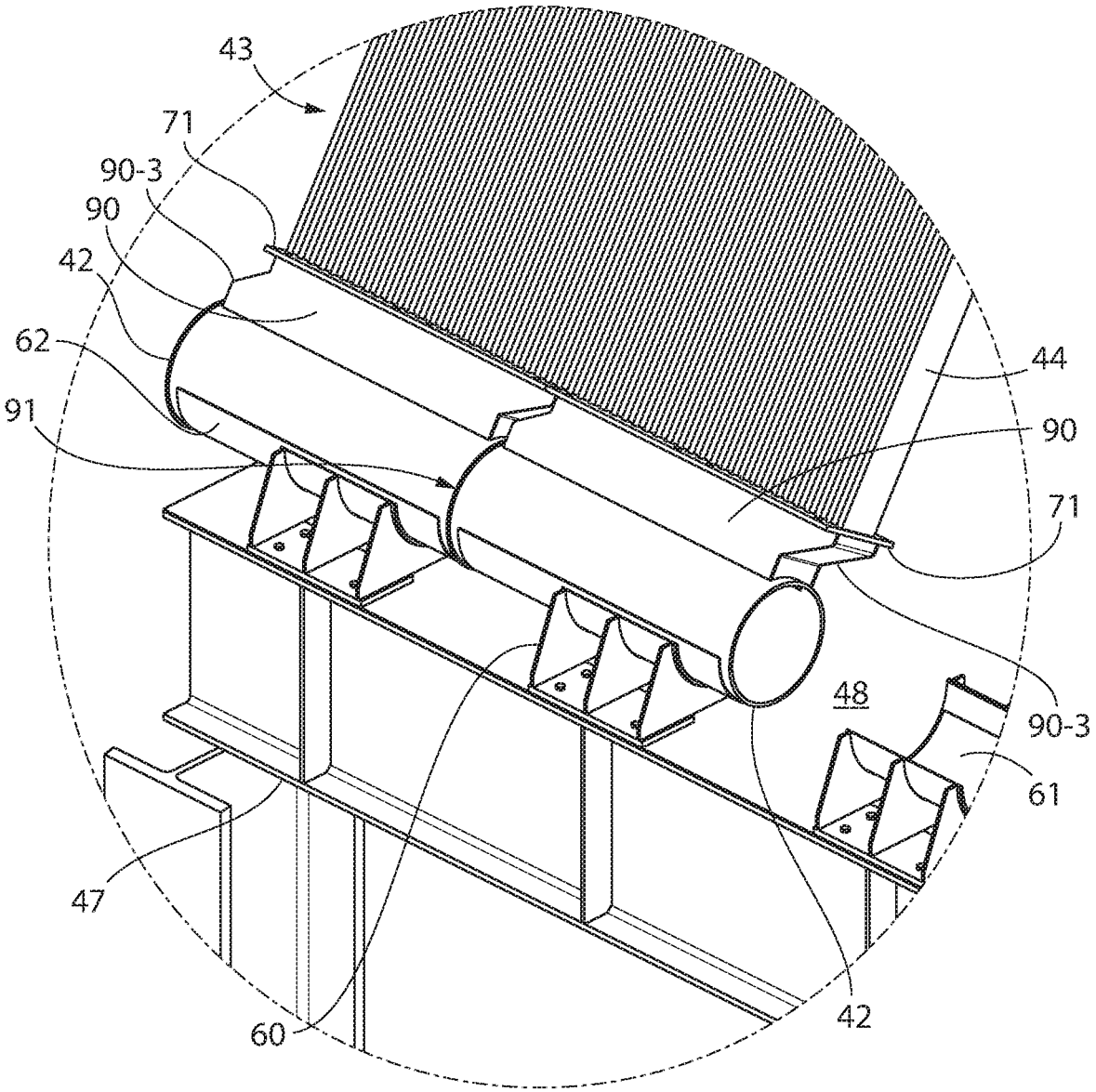
FIG. 3 is detail taken from FIG. 2 of the tube bundle to condensate header fluid connection showing the condensate flow plenums and header saddle supports.

FIG. 2 is a perspective view of a portion of ACC 40 according to the present disclosure showing the general construction and arrangement of the foregoing common steam header 41, condensate headers 42, and inclined tube bundles 43. Part of the front tube bundles are removed for clarity to show interior features of the ACC.

Referring to FIGS. 2-12, the ACC 40 may be a single row finned tube heat exchanger design comprising a plurality of inclined/angled tube bundles 43 arranged in an A-shaped construction in one configuration with an acute angle formed between opposing walls or panels of tube bundles. Each of the tube bundles 43 on the same side of the "A" are arranged in laterally adjoining side-by-side relationship as shown. The number of tube bundles will be dictated by the cooling requirements of the design. Each tube bundle is fluidly coupled to the common steam header 41 at top and one of the condensate headers 42 at bottom. One or more fans 50 arranged below the A-frame tube bundles blow ambient cooling air upwards through the tube bundles 43 to condense steam flowing downwards through the tube side of the tubes 44. Accordingly, each fan 50 has a bottom suction side for drawing ambient cooling air into the fan, and a top discharge side for discharging the air towards the tube bundles 43. The condensed steam now in liquid state (i.e. condensate) collects in the bottom condensate headers 42, as previously described herein.

It bears noting the ACC 40 shown in FIG. 2 is one of multiple ACCs which may be provided in a complete ACC system installation. Each ACC may be thought of as a cooling cell or unit which can be fluidly coupled together in a concatenated fashion in series at the steam and condensate header joints to provide the entire cooling duty required to condense the steam and return the condensate to the Rankine cycle flow loop. Each cooling cell shown in FIG. 2 may include multiple tube bundles 43 on each side (the left-most tube bundle in front showing a single tube bundle and the rear showing multiple tube bundles). The steam and condensate headers 41, 42 may be a single monolithic continuous flow conduit within each cell or be comprised of multiple header sections which are fluidly coupled together within each cell to form the continuous flow conduit.

ACC 40 includes a longitudinal axis LA which is defined by the axial centerline of common steam header 41 for convenience of reference. This also defines a corresponding axial direction which may be referred to herein. A vertical centerline Cv of the ACC is defined by the vertical centerline of the steam header which intersects the longitudinal axis LA (see, e.g. FIG. 4). The steam header further defines a horizontal reference plane Ph which intersects the vertical centerline Cv and longitudinal axis LA. The longitudinal axis, vertical centerline, and horizontal reference plane define a convenient reference system for describing various aspect of ACC 40 and their relationship to one another.

Referring generally to FIGS. 2-12, ACC 40 includes a fan platform 45-1 comprising a support frame 45 which supports the fan 50, condensate headers 42, and other appurtenances. The condensate headers 42 in turn support the tube bundles 43 and steam header 41. The fan support frame 45 may comprise a combination of vertical structural columns 46, longitudinal beams 47, and lateral beams 48 spanning between the longitudinal beams in a conventional manner. Columns 46 are arranged to engage a horizontal support surface typically at ground level (e.g. concrete foundation). The fan platform 45-1 comprises fan deck plate 51 which is supported by the beams 47, 48 to provide access to the fan and its ancillaries. The fan deck plate 51 includes a relatively large vertical opening 49 in which fan 50 is mounted. The fan assembly further comprises an annular fan ring 52 supported from the fan deck plate 51, electric motor 53, and gear box 54 coupled to the hub of the fan 50 from which the fan blades 56 project radially outwards as shown. The motor and gear box may be disposed on top of the fan in one non-limiting construction as shown. The fan 50 may be mounted and supported in the fan ring 52 by supporting the gear box 54 from the frame, such as in some arrangements via horizontally extending fan support beams 57 (represented schematically by a dashed line) tied into the support frame and/or fan deck plate 51. Other fan support structural arrangements may of course be used and does not limit the invention. The fan deck plate 51 is elevated above the ground by support frame 45 to allow cooling air to enter the fan 50 from below and be discharged upwards through the tube bundles 43.

Referring to FIGS. 2-5, the peripheral ends of the fan deck plate 51 may support the condensate headers 42, which in turn support the tube bundles 43 and steam header 41 at the vertex between the bundles. The condensate headers 42 are supported from the fan deck plate 51 by a plurality of axially spaced apart saddle supports 60. Supports 60 may be fixedly attached to the fan deck plate 51 and/or longitudinal beams 47 such as via bolting (shown) or other suitable methods (e.g. welding). A horizontal base plate 63 may be provided on each support 60 which is configured for direct attachment to beams 47 in a fixed and rigid manner. The support thus remains stationary and fixed to the ACC support frame 45 irrespective of an thermal expansion of the fluid pressure boundary components. The fan deck plate 51 may be cut out around the saddle supports 60 (shown) or may extend beneath support base plates 63 in other embodiments contemplated.

Figure 5:
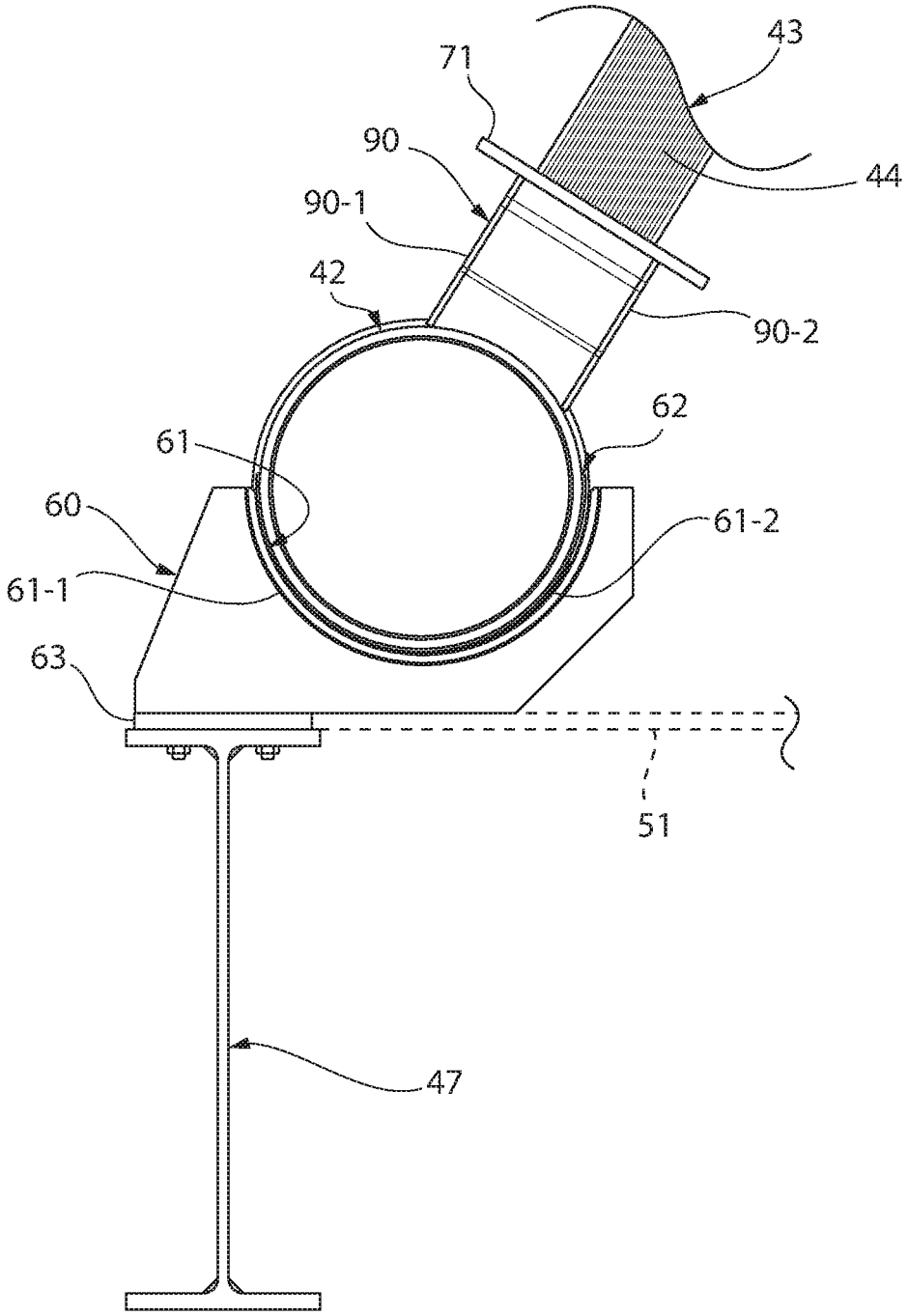
FIG. 5 is an enlarged detail taken from FIG. 4 showing the saddles supports.

Each saddle support 60 includes an upwardly open arcuately curved cradle plate 61-1 defining a concave support surface 61 configured to engage the lower portion of the condensate headers 42 (best shown in FIG. 5). Support surface 61 may be semi-circular in transverse cross section as shown having a complementary configuration to and diameter just slightly larger than the circular condensate headers 42 to produce conformal contact with the header when positioned thereon. The condensate headers 42 are not fixedly attached to the support saddles 60 or any other supports in one embodiment. This supports the condensate headers 42 (and weight of the tube bundles 43 and steam header 41) vertically, but the condensate headers are otherwise longitudinally unrestrained on the curved saddle supports. This arrangement advantageously allows the condensate headers (and tube bundles and steam header) to advantageously grow or contract in the longitudinal direction by sliding on the saddle supports 60 without developing stresses from restraint of thermal expansion or contraction which may induce thermal stress cracking. The headers 42 thus are slideable in the longitudinal direction in relation to the saddle supports.

In one embodiment, the curved support surface 61 may include an anti-friction coating 61-2 such as Teflon® or similar material to allow for smooth sliding engagement at the interface between the condensate headers 42 and saddle supports 60. In one embodiment, an arcuately curved and semi-circular wear plate 62 may be rigidly attached to the bottom half of the headers 42 to facilitate engagement with the saddle support surface 61 and prevent direct wear on the outer pressure boundary of the header. The wear plate 62 may be made of a suitable metal preferably welded to the headers 42, such as stainless steel in one embodiment. Other suitable metals for this application may be used.

Preferably, the saddle supports 60 are configured and constructed to be structurally robust enough to support the entire weight of the condensate headers 42, tube bundles 43 and steam header 41 without reliance upon any direct attachment to or direct support of the tube bundles 43 from the fan support frame 45 or other structural members tied into the support frame unlike prior A-frame ACC designs described in the Background. by contrast, tube bundles in these prior designs are affixed to and directly supported by the structural A-frame. In the present design, the weight of the tube bundles 43 may thus be supported only by the condensate headers 42, which in turn are supported by the saddle supports 60 affixed to the fan support frame 45. Because of the stiffness of the panels of rectangular tubes 44 and the robust saddle supports 60 which allow longitudinal expansion/contraction of the condensate headers 42, the A-shaped geometry of the tube bundles 43 is sufficiently self-supporting and rigid to meet the governing structural requirements (snow, wind & earthquake) at most installation sites. However, in certain installation sites subject to extreme weather-related or seismic conditions, braces and/or guy wires, frequently used to strengthen tall columns against winds and earthquakes, may be used to suitably brace the A-shaped tube bundles if necessary.

The fluid pressure boundary components of ACC 40 will now be further described with general reference to FIGS.

2-12. These components generally include the longitudinally-extending common steam header 41 at top, pair of longitudinally-extending condensate headers 42 at bottom, and tube bundles 43 each extending at an acute angle to vertical centerline Cv of ACC 40 between the steam header and a respective one of the condensate headers. Each tube bundle 43 defines a tube bundle axis Ta (see, e.g. FIG. 6). In the triangular or A-shaped arrangement of the tube bundles 43, the tube bundle axis TA of a first tube bundle on one side of ACC 40 is arranged angularly at an acute angle A1 to the tube bundle axis TA of the second tube bundle. In one embodiment, angle A1 may be between 0 and 90 degrees, and in one representative non-limiting example may be about 60 degrees. Other angles may be used. The tube bundles 43 converge towards each other but the upper tubesheets 70 do not meet. The tube bundle axes TA intersect at a vertex V which is located inside the steam header 41 proximate to the bottom opening 84 of the header in one embodiment (see, e.g. FIG. 6). The tube converging tube bundles form the A-shaped tube bundle configuration.

The tube bundles 43 in one embodiment may be shop-manufactured straight and generally planar/flat tube bundles each comprised of closely spaced apart parallel tubes 44 aligned in a single linear row and arranged in a single plane. Tubes 44 may have an obround or rectangular cross section (see, e.g. FIGS. 8 and 9). Each straight tube is fluidly connected at opposite ends to and supported by an upper tubesheet 70 and lower tubesheet 71. The tubesheets 70, 71 contain a plurality of tube penetrations for allowing steam or condensate to flow into and out of the tubes 44 on the open interior tube side of the tubes which define flow passageways. The tube ends may fixedly coupled to the tubesheets in a leak-proof manner by being seal welded, brazed, or expanded (e.g. hydraulically or explosively) to the tubesheets to form fluidly sealed connections. The tubesheets 70, 71 may flat in one embodiment and formed of straight metallic plates.

Figure 9:
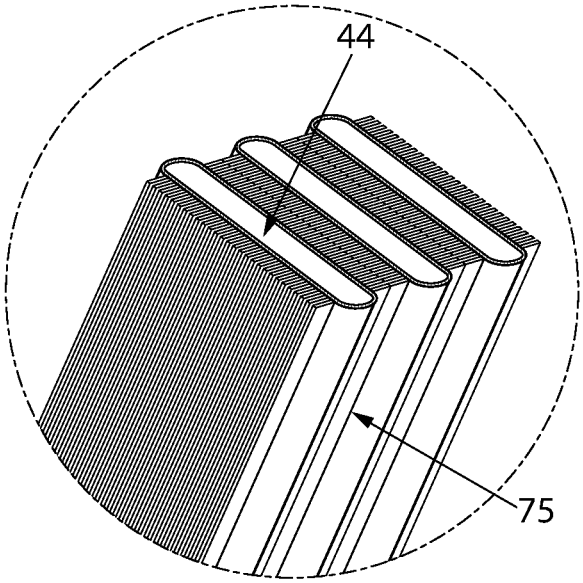
FIG. 9 is a perspective view of the ends of some tubes before sealably joined to an upper tubesheet.
Figure 8:
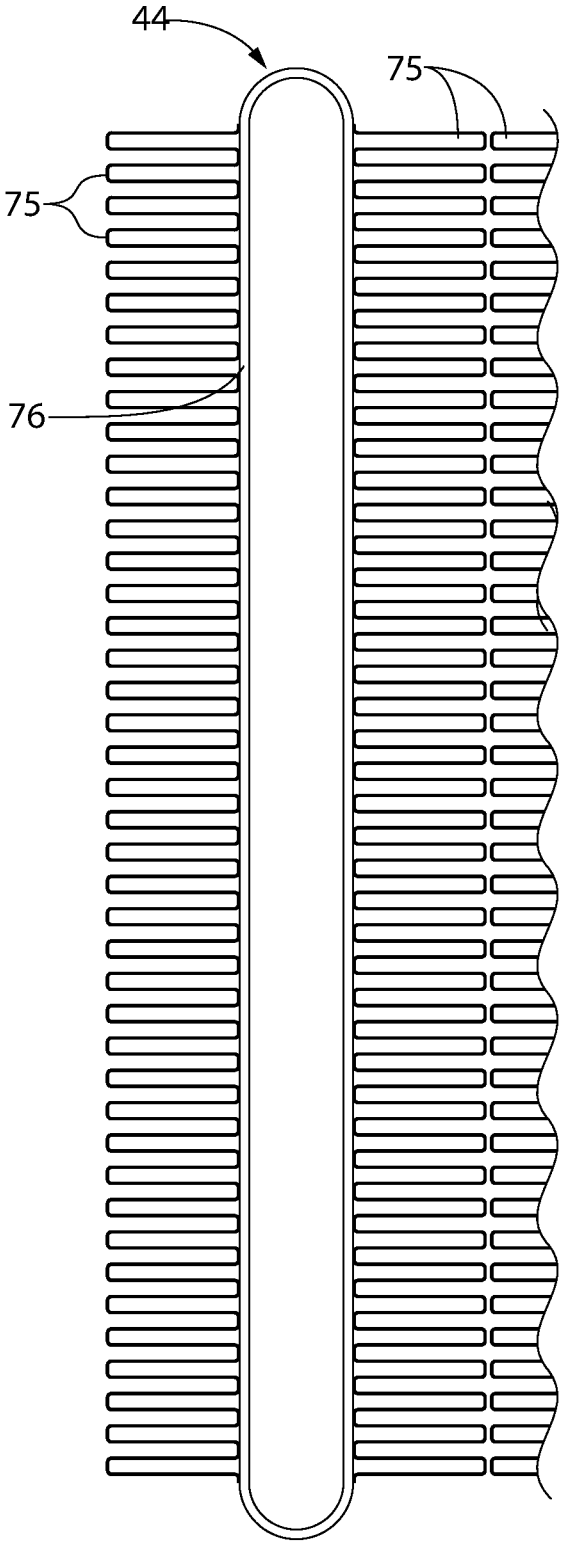
FIG. 8 is a side cross-sectional view of a finned tube of a tube bundle.
Figure 10:
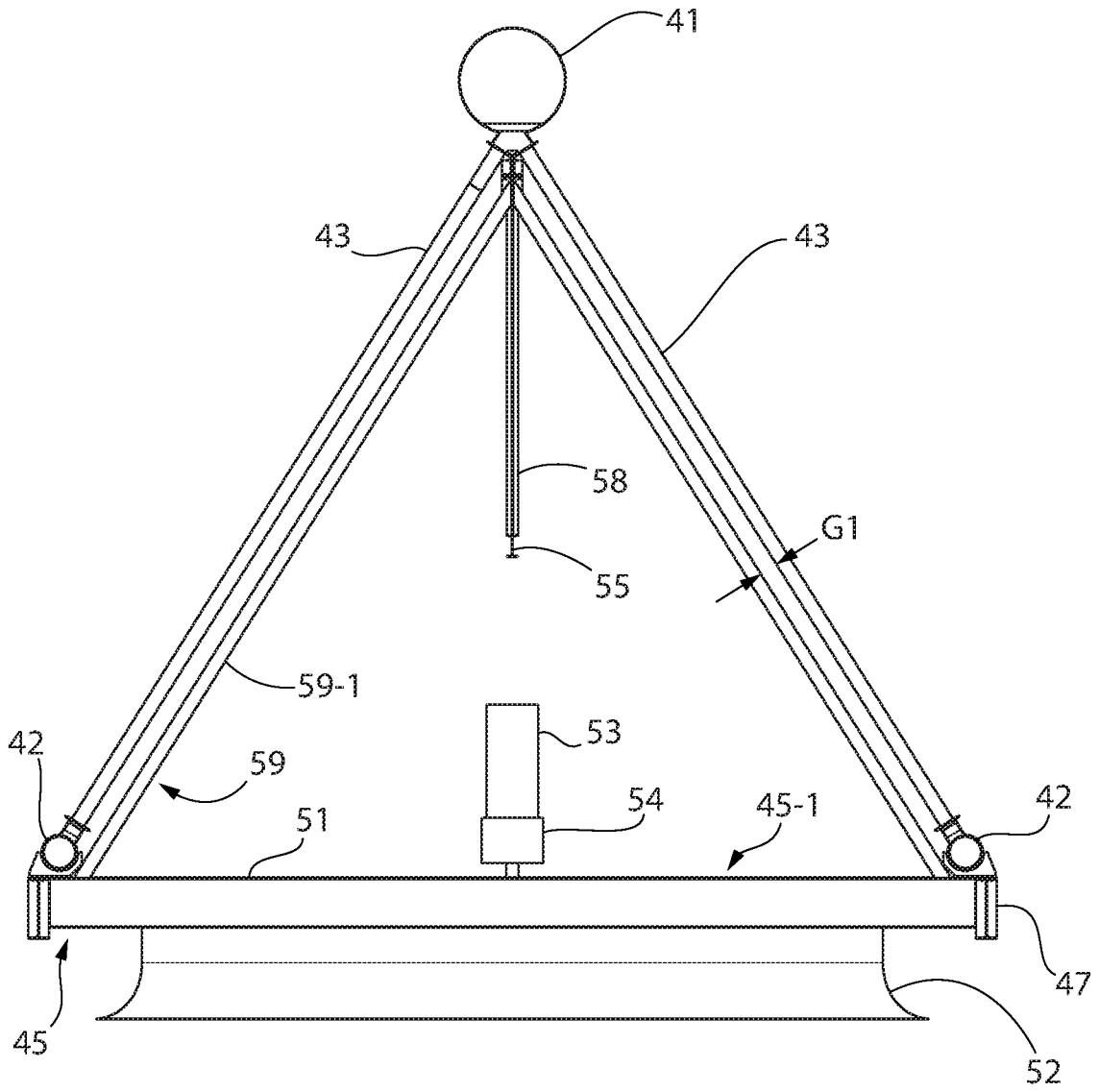
FIG. 10 is an end view of the ACC of FIG. 2.
Figure 11:
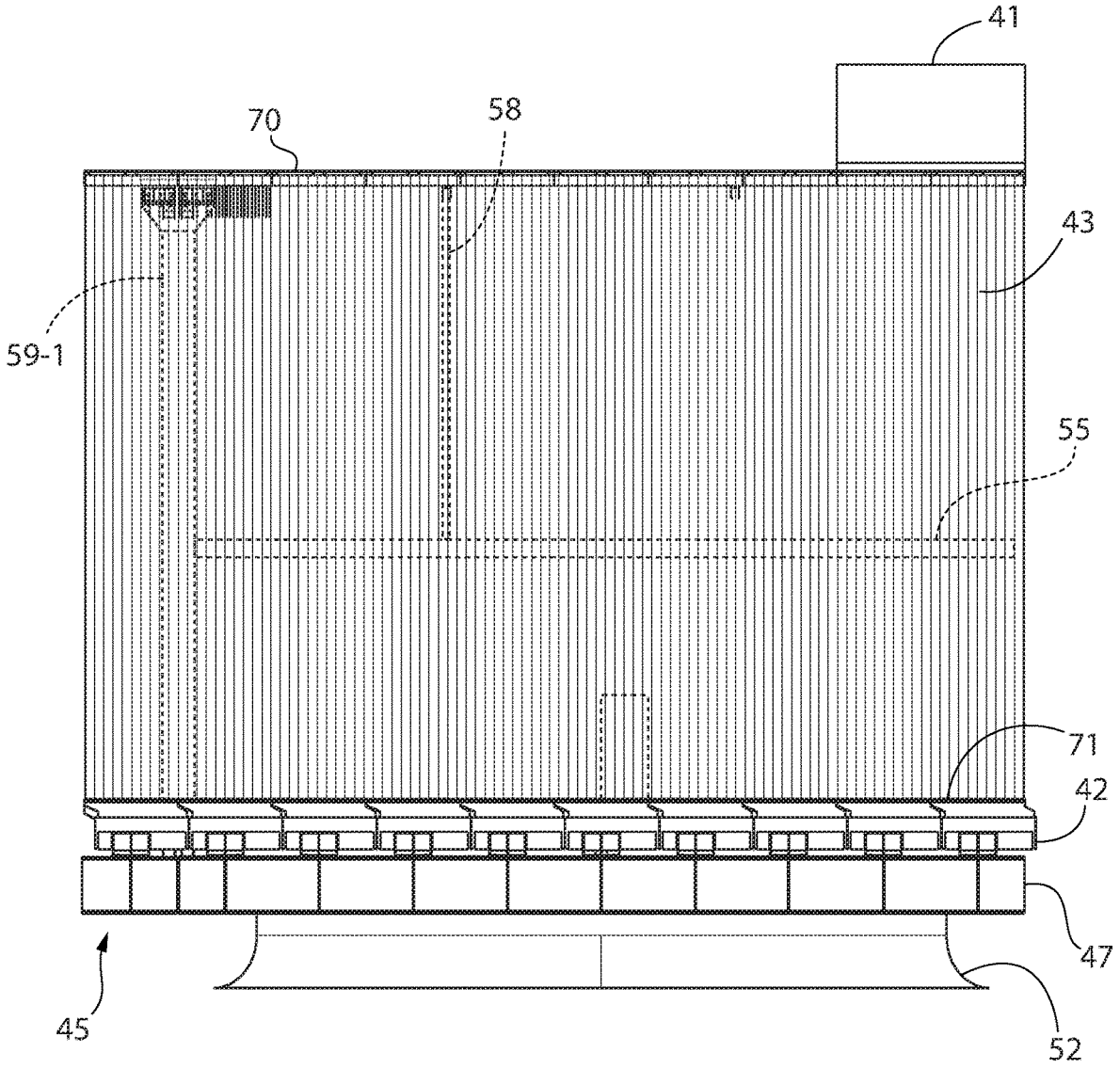
FIG. 11 is a side view of the ACC.
Figure 12:
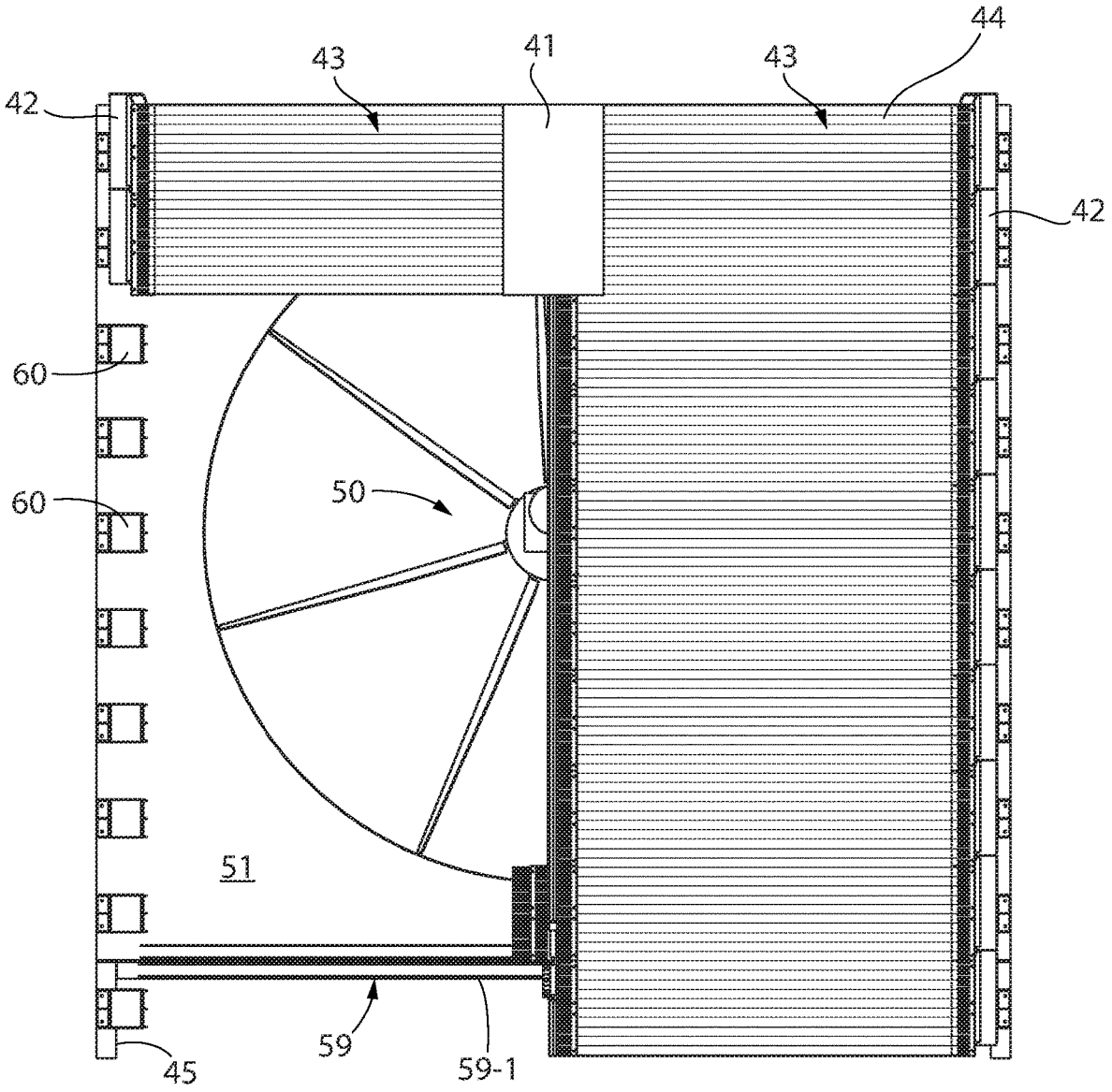
FIG. 12 is a top view of the ACC.
Figure 13:
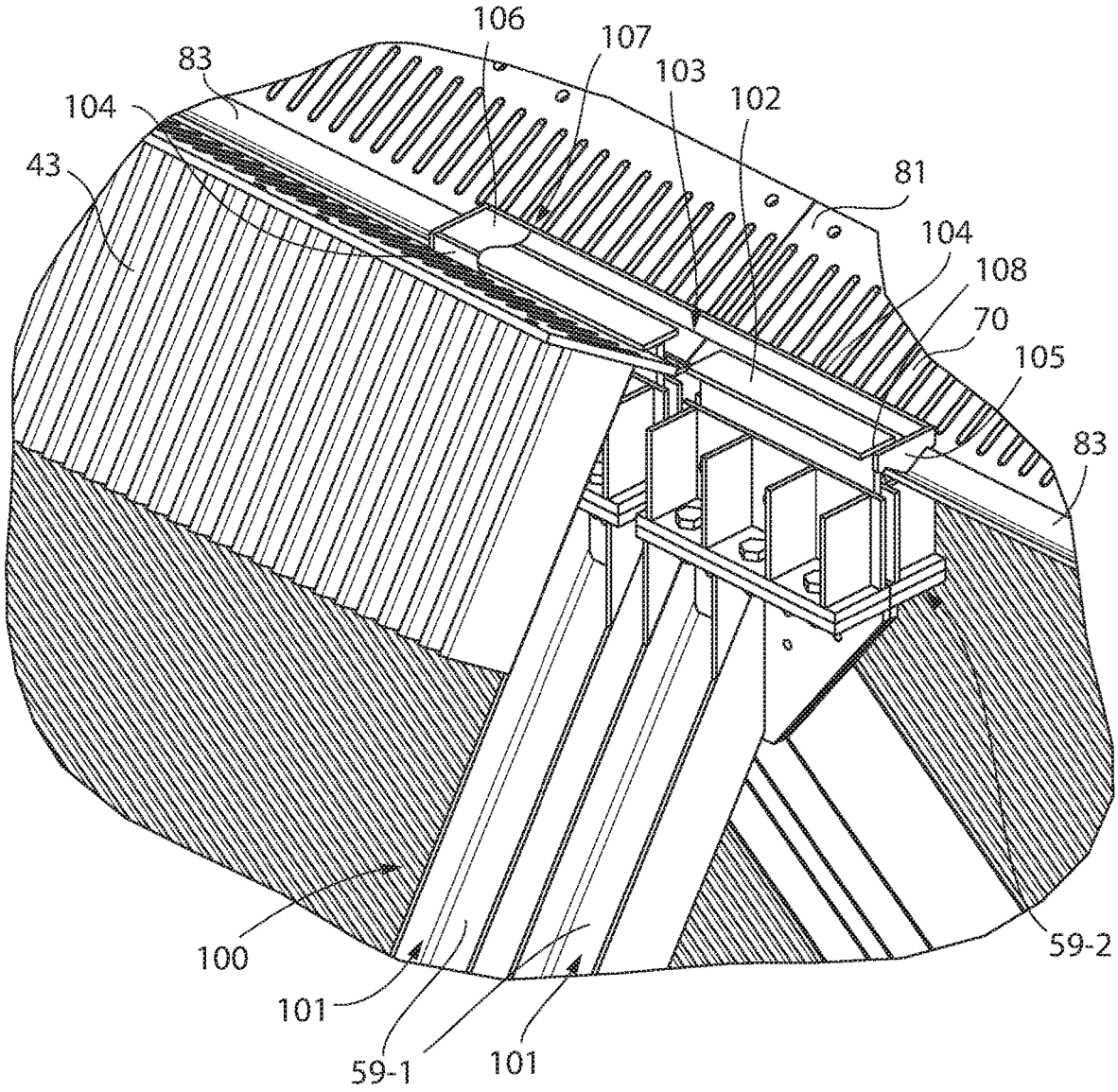
FIG. 13 is a perspective view of the tube bundle upper tubesheets area with steam flow plenum removed to better show a thermal expansion restraint system and upper coupling portion of a thermal restraint unit.
Figure 14:
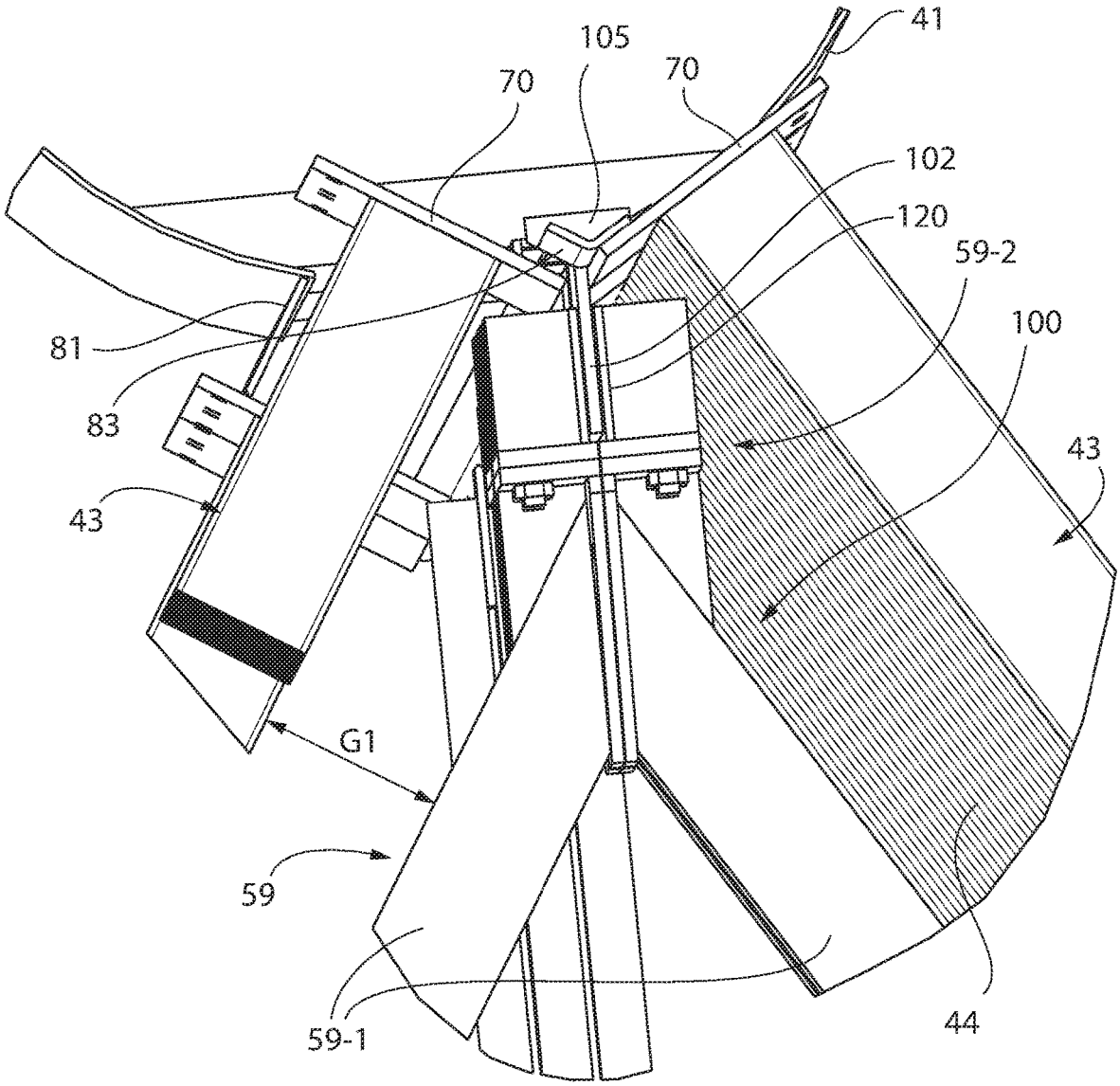
FIG. 14 is an end perspective view thereof.
Figure 15:
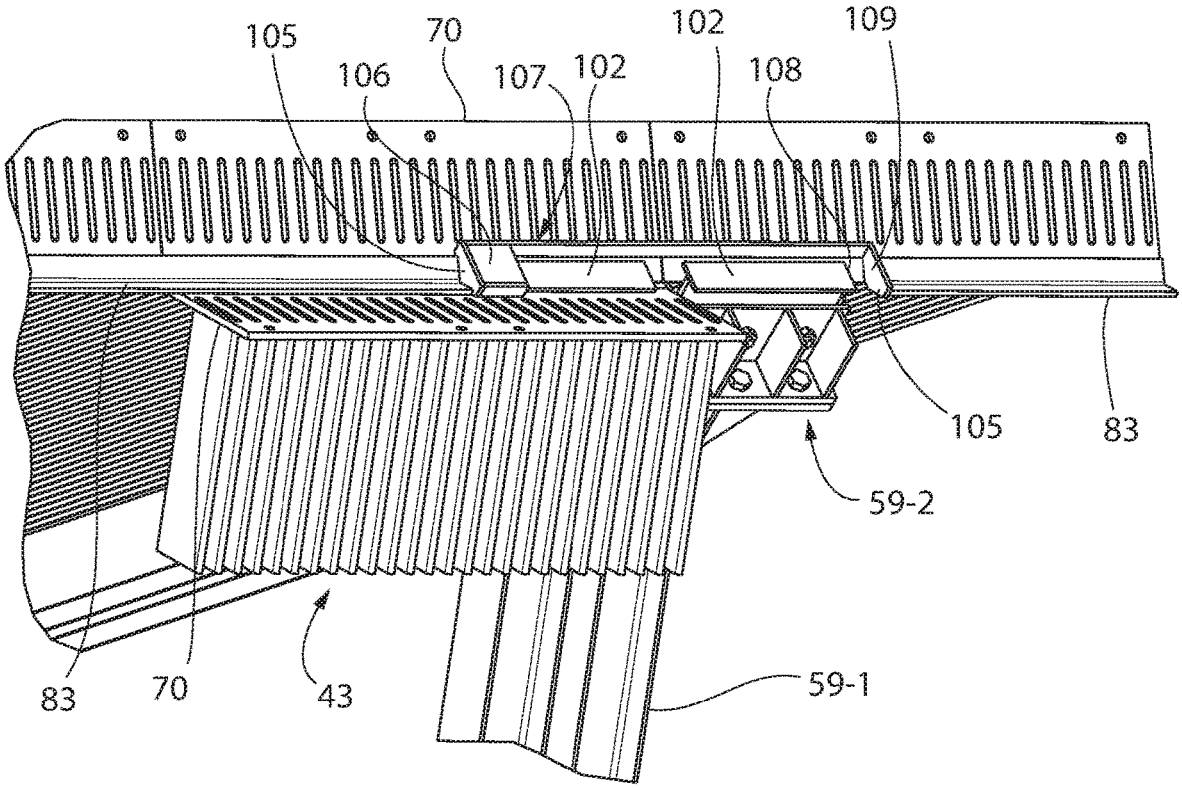
FIG. 15 is a top perspective view thereof.
Figure 16:
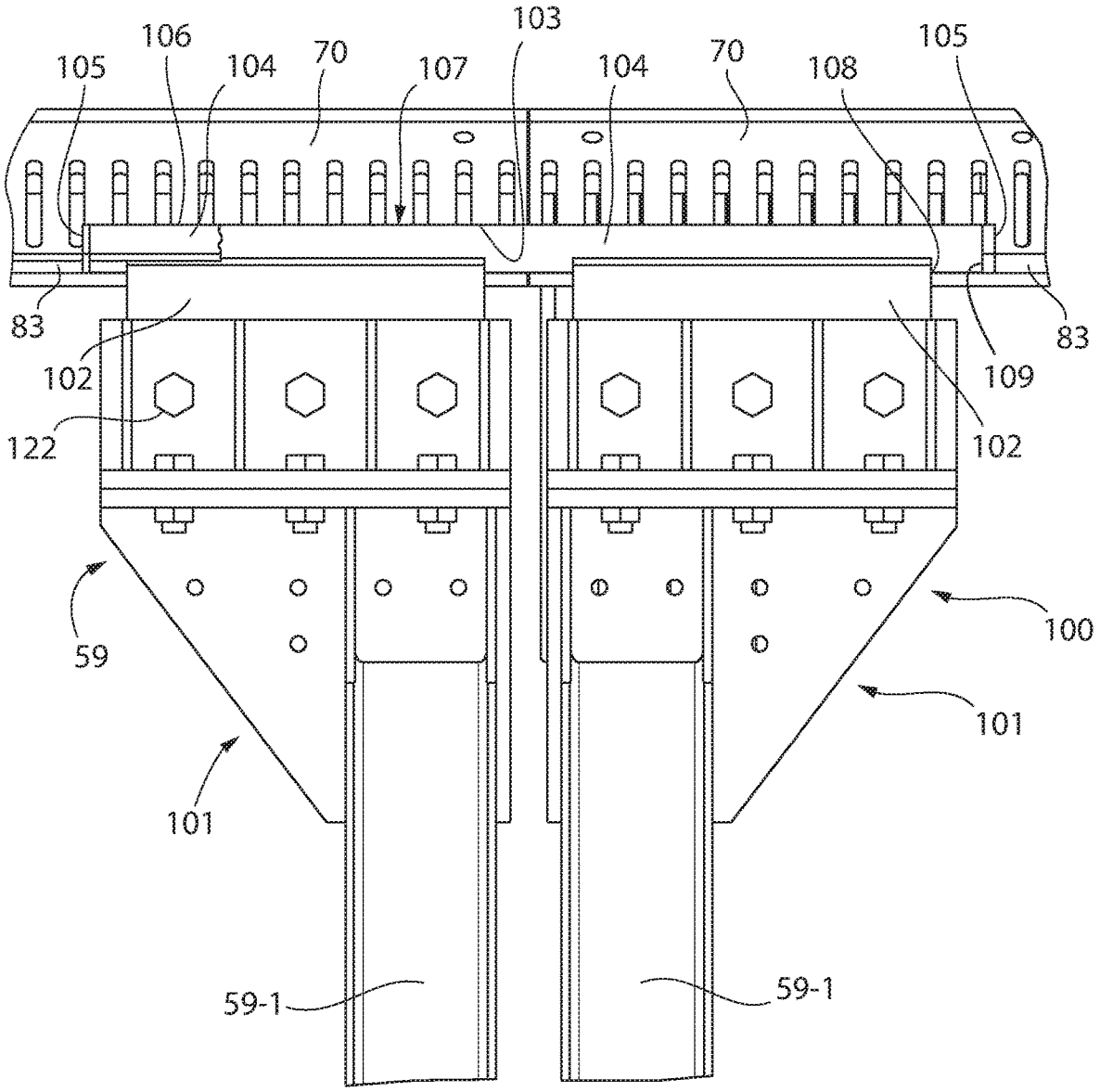
FIG. 16 is a side view thereof.
Figure 17:
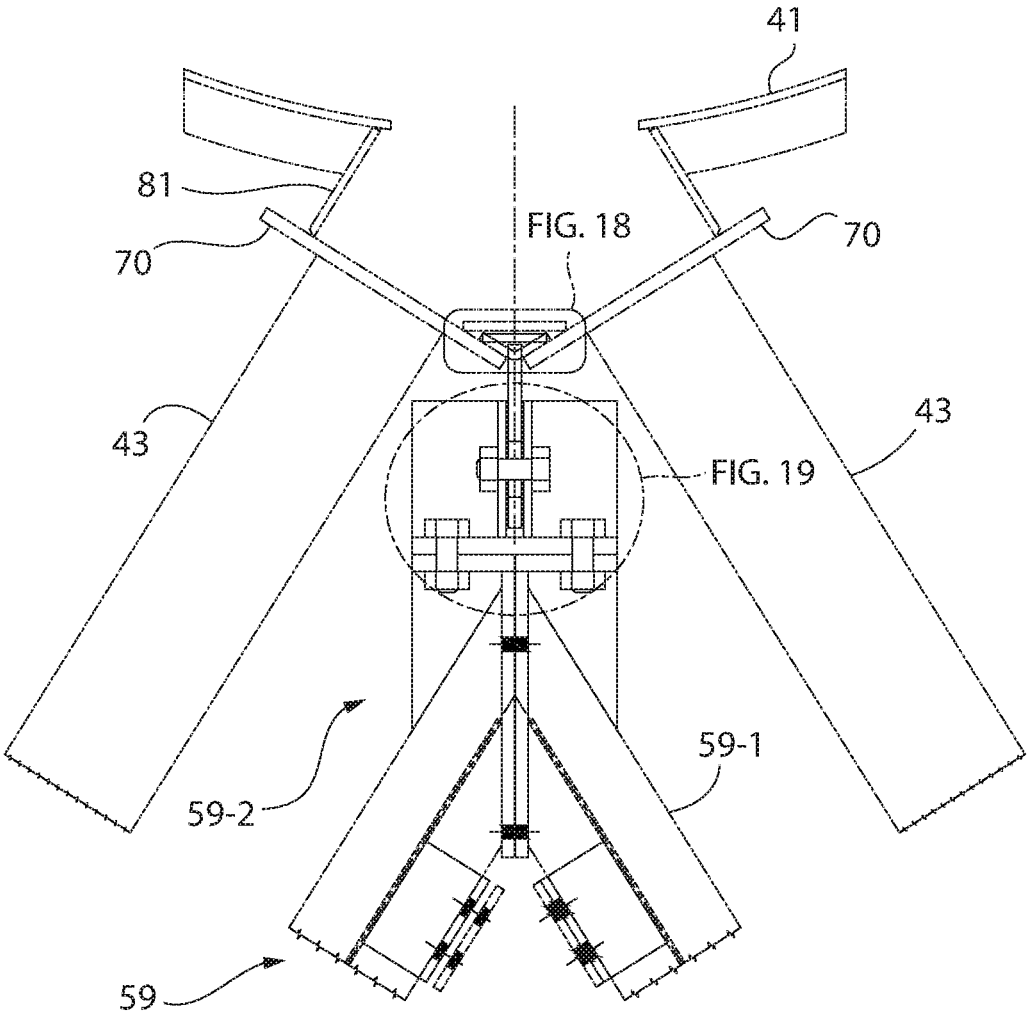
FIG. 17 is an end view of the coupling portion of the thermal restraint unit showing the sliding expansion joint assembly.
Figure 18:
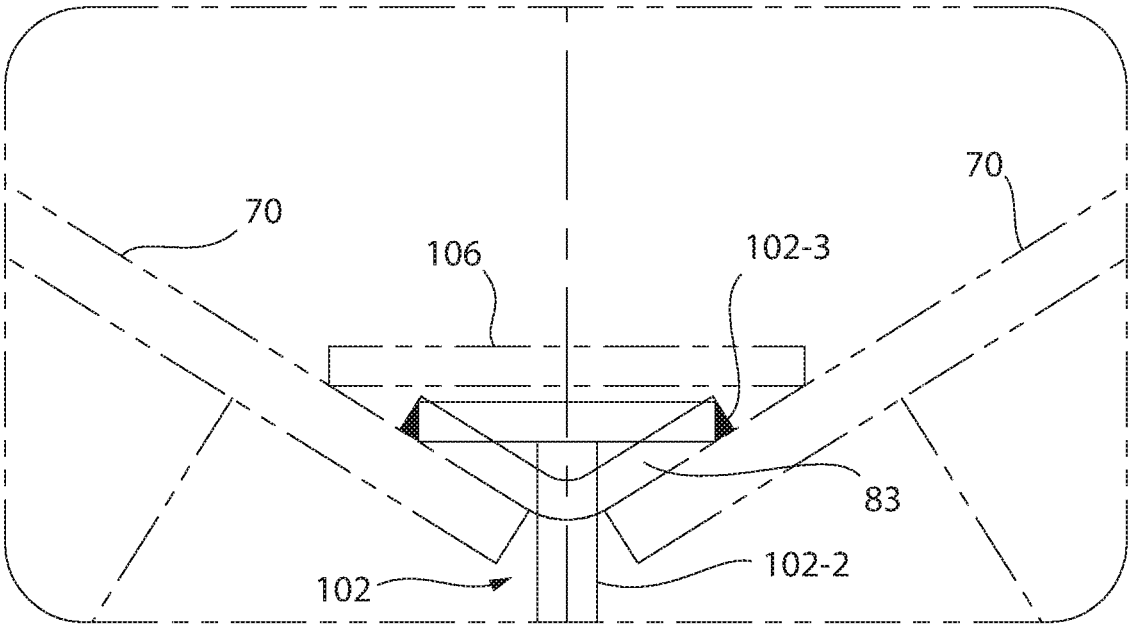
FIG. 18 is an enlarged detail taken from FIG. 17.
Figure 19:
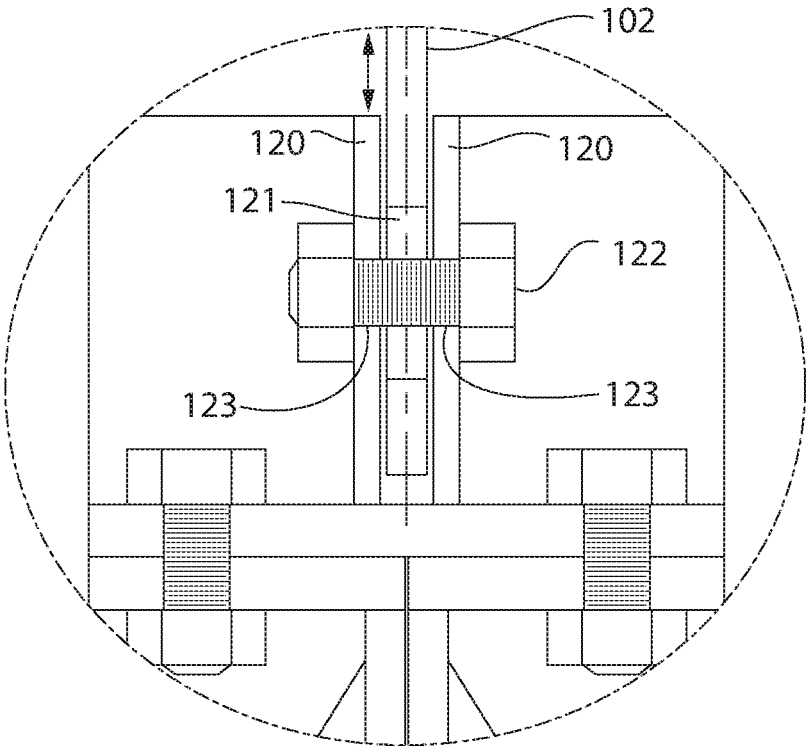
FIG. 19 is another enlarged detail taken from FIG. 17.
Figure 20:
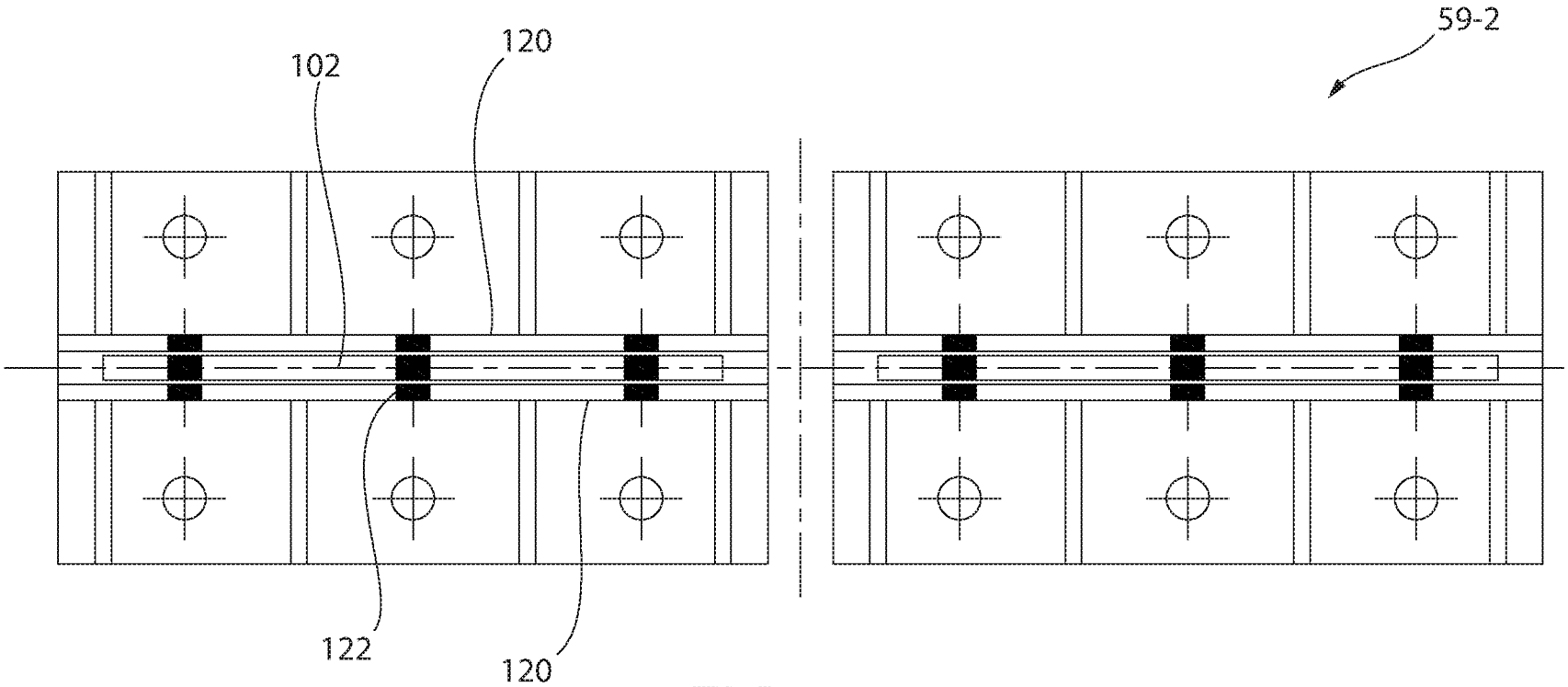
FIG. 20 is a top view of the sliding expansion joint assembly of FIG. 17.
Figure 21:
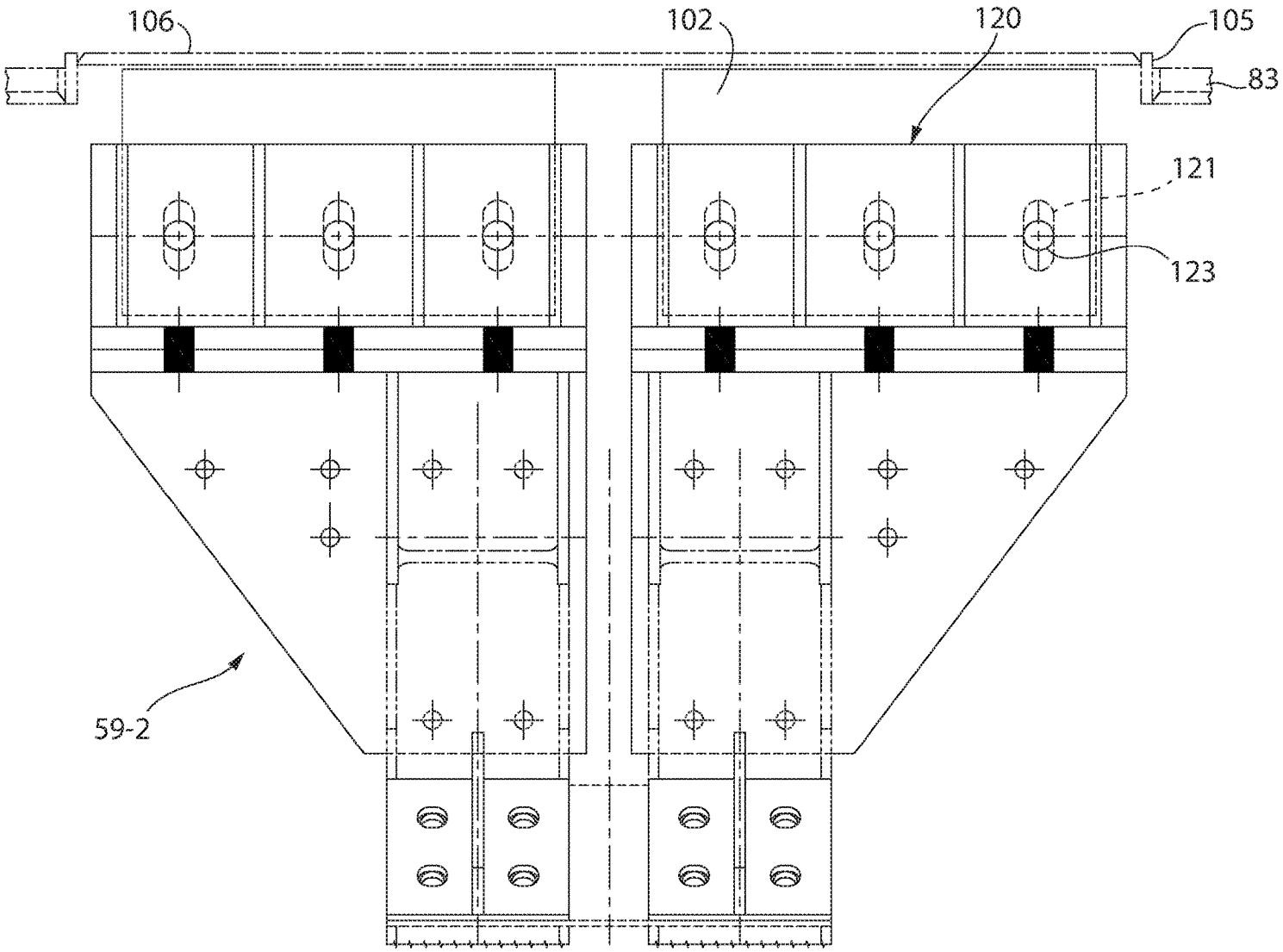
FIG. 21 is a side view thereof.

In one embodiment, the tubes 44 may include heat transfer fins 75 attached to opposing flat sides 76 of the tubes and projecting perpendicularly outwards therefrom in opposing directions, as shown in FIGS. 8 and 9. When the tube bundles 43 are assembled, the fins of one tube 44 preferably are very closely spaced in relation to the fins of an adjoining tube to ensure cooling airflow generated by fan 50 through the tube bundle comes into maximum surface contact with the fins for optimum heat exchange and steam condensing. In other implementations, the tubes may be finless.

Referring generally to FIGS. 2-12, each tube bundle 43 is fluidly coupled to a longitudinally-extending steam flow plenum 80 at top and a respective longitudinally-extending condensate flow plenum 90 at bottom. The steam and condensate flow plenums each forms a transition from the flat upper and lower tubesheets 70, 71 to the arcuately curved sidewalls of the steam and condensate headers 41, 42.

Condensate flow plenum 90 may be generally a rectilinear box-like structure in one embodiment arranged to fluidly couple each tube bundle 43 to a respective condensate header 42 (see, e.g. FIGS. 2-5) on each side of ACC 40. The lower tubesheets 71 are sealably attached or joined (e.g. seal welded) to the condensate flow plenums 90, and form an integral top end portion of the flow plenums 90. Each tube 44 is in fluid communication with the condensate flow plenum interior volume. The bottom end portion of flow plenums 90 penetrate are sealably joined (e.g. seal welded) to condensate headers 42 forming a fluid passageway between the tube bundles and condensate headers. The four sidewalls of the condensate flow plenums are solid and closed to complete the pressure retention boundary of the condensate flow plenums 90. The opposing front and rear lateral sidewalls 90-1, 90-2 may be flat and parallel to each other. In one embodiment best seen in FIG. 3, the top ends of each condensate flow plenum 90 may be laterally offset from the bottom end. Accordingly, the zig-zag shape of the flow plenums 90 (e.g. lateral sidewalls 90-3) create laterally open recesses between the plenums which allow one plenum 90 to at least partially nest within the adjacent condensate flow plenum 90 to facilitate assembling the tube bundles 43 in the field.

Figure 4:
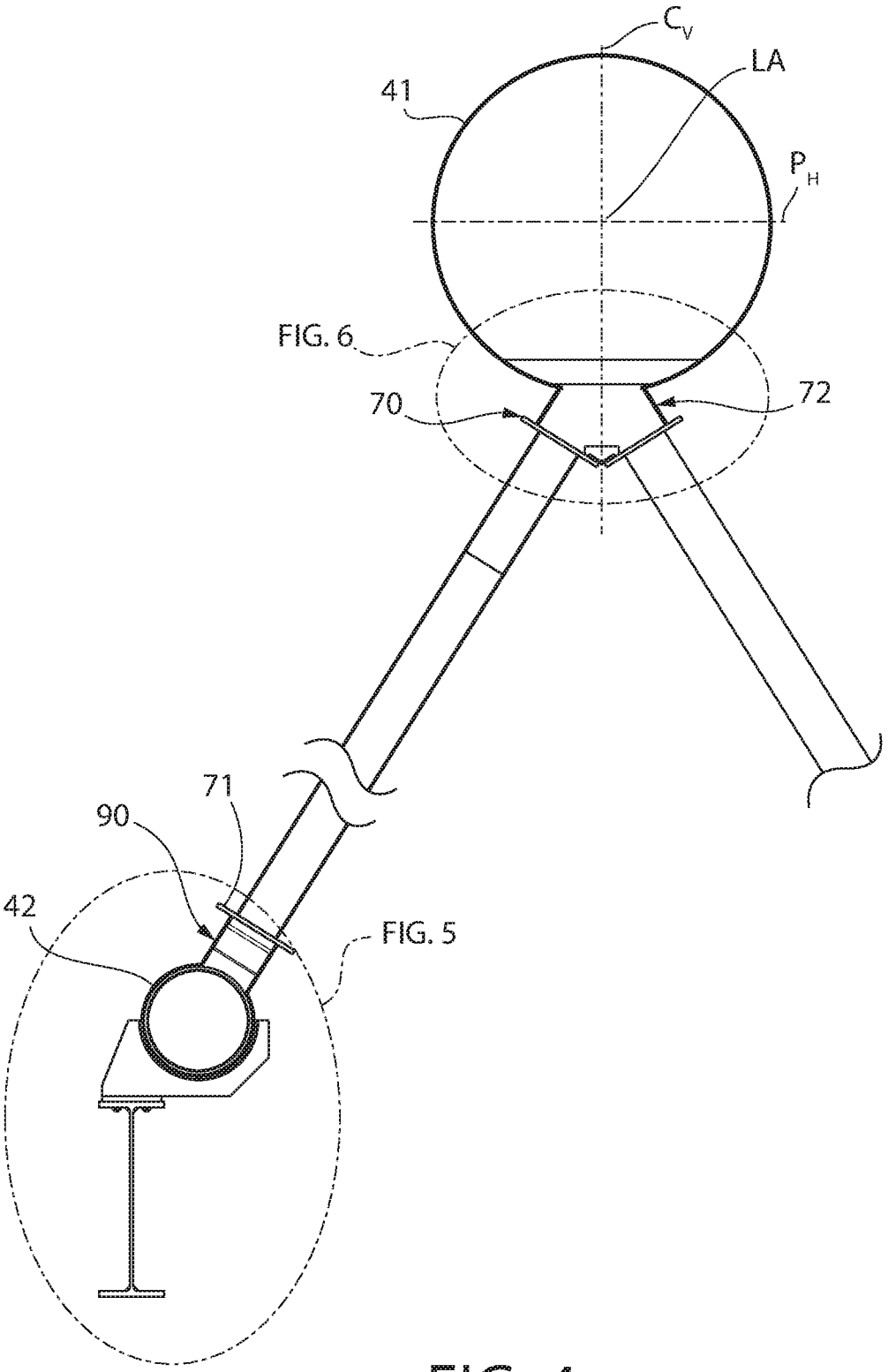
FIG. 4 is a partial end view of the ACC showing the steam and condensate header arrangement.
Figure 6:
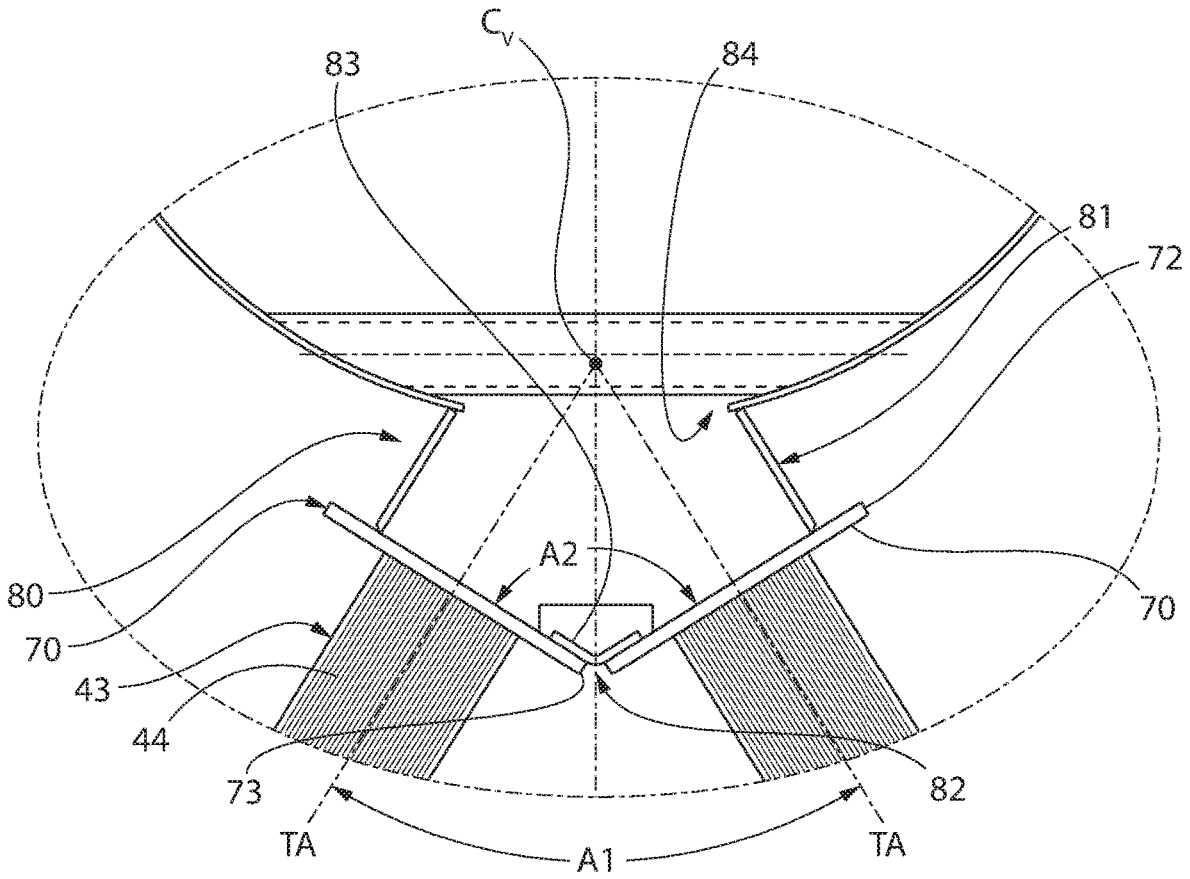
FIG. 6 is an enlarged detail taken from FIG. 4 showing the steam header and its associated plenum.
Figure 7:
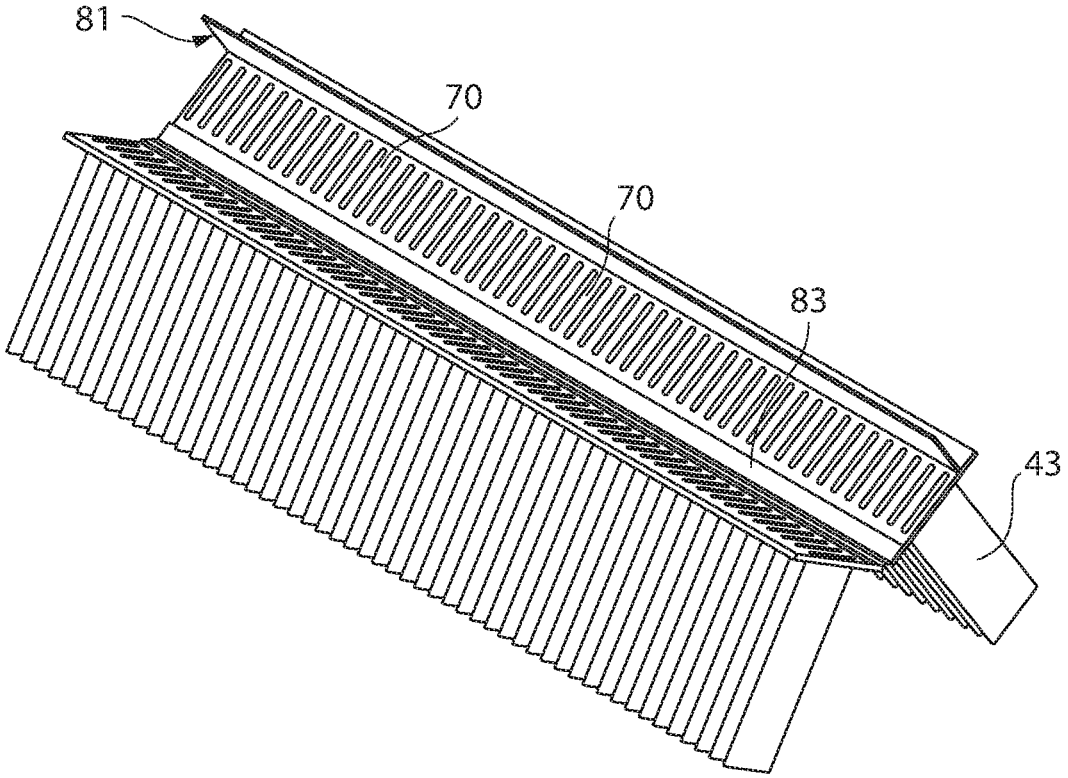
FIG. 7 is a perspective view of the upper portion of the tube bundles showing the upper tubesheet arrangement between the pair of the acutely angled tube bundles and seal plate therebetween.

Referring to FIGS. 2, 4, and 6, steam flow plenum 80 may be a generally rectilinear box-like configuration in one embodiment as illustrated. Plenum 80 is arranged to fluidly couple each tube bundle 43 to the steam header 41. The steam flow plenum comprises an opposing pair of longitudinally-extending side skirt plates 81 seal welded to the steam header 41. Skirt plates 81 extend downwards from the steam header. In one configuration, skirt plates 81 may each be disposed at an acute angle to the vertical centerline Cv of the ACC defined by centerline of the steam header 41. In other possible configurations, the skirt plates 81 may instead be oriented parallel to centerline Cv. The upper tubesheets 70 of each tube bundle are each sealably attached or joined to one of the skirt plates 81 such as via seal welding, thereby forming a longitudinally-extending integral and angled bottom wall at the bottom end of the fluidly sealed steam flow plenum. Each tube 44 is in fluid communication with the steam flow plenum interior volume. The top end portion of flow plenum 80 penetrates and is sealably joined or welded to steam header 41 forming a fluid passageway between the tube bundles and header for introducing steam into the tubes 44.

In one embodiment, steam flow plenum 80 may be a pentagon-shaped in transverse cross section as best shown in FIG. 6. Each upper tubesheet 70 is acutely angled to each other at angle A2 (previously described herein) to define a V-shaped bottom wall of the flow plenum 80. Skirt plates 81 are be oriented perpendicularly to each of their respective tubesheet 70 to which they are seal welded to form the pressure retention boundary. The skirt plates 81 may be attached to each upper tubesheet 70 proximate to the outboard longitudinal edges 72 of the tubesheets.

A longitudinally-extending bottom opening 84 in steam header 41 allows steam entering the header to turn and flow downwards through the opening into the plenum 80. Bottom opening may be continuous along the length of the header 41 or be comprised of intermittent openings spaced axially apart on the bottom of the header.

The inner longitudinal edges 73 of the upper tubesheets 71 may be spaced apart forming a longitudinally-extending open joint 82 between the adjacent tubesheets. In one embodiment, the joint is closed and fluidly sealed by a hinged flexible coupling comprising a resiliently deformable curved or angled metallic seal plate 83 which extends longitudinally along the tubesheets. The angled seal plate 83 has a resiliently flexible monolithic metal body with an elastic memory which provides limited deformation capabilities thus allowing for some degree of transverse expansion/contraction and vertical growth/contraction of the tube bundles 43. The seal plate fluidly and hermetically seals the open joint 82 between the two upper tubesheets 70. Accordingly, seal plate 83 includes opposing and parallel longitudinal edges each of which are sealed welded to one of the upper tubesheets to form a fluidly sealed interface with the steam plenum 80, thereby closing the plenum. Seal plate 83 is a continuous structure having a length coextensive with the longitudinal lengths of the upper tubesheets 70 and joint 82 therebetween to fluidly seal the steam flow plenum 80 at the bottom between the tubesheets. In one embodiment, the seal plate may be a metal structural angle having an obtusely angled configuration in transverse cross section (best shown in FIG. 6). The bottom peripheral edge surface of the seal plate abuts and rests flatly on the tubesheets 70 as shown. The two angled sides of the seal plate are disposed at the same angle A2 to each other as formed between the two tubesheets 70.

Each of the steam and condensate headers 41, 42 may be formed from discrete sections of preferably circular piping for hoop stress resistance in one embodiment having adjoining ends which are abutted together at joints 91. The steam header will be larger than either of the condensate headers. The bottom condensate and the steam headers 42, 41 may be oriented parallel to each other in the illustrated embodiment. The condensate headers 42 in one configuration may be laterally spaced apart on opposite sides of ACC 40.

Each pair of condensate header 42 sections with associate condensate flow plenum 90, steam header section 41 with associated steam flow plenum 80, a first tube bundle 43, and an opposing second tube bundle 43 forming an A-shaped tube bundle structure may be considered to a discrete cooling cell for condensing steam which may be shop fabricated to allow for tight control of tolerances and fit-up. This construction forms a self-supporting tube bundle structure. The cooling cells may be arrayed and fluidly interconnected in a series forming a linear row of cooling cells. Multiple parallel, perpendicular, or other arrangements of cooling cells may be provided to achieve the required heat transfer surface area of tubes necessary for the cooling duty of the ACC. The joints 91 between headers 41, 42 of adjoining cooling cells are fluidly and sealably coupled together to form contiguous header flow passageways between cells for both steam and condensate flow. The ends of the headers may be coupled together at joints 91 therebetween by any suitable means such as bolted piping flanges, welded piping connections, or combinations thereof. In one embodiment, bolted and gasketed flanges may be used to minimize piping field welds.

In operation on the pressure boundary side of the ACC, steam enters the steam header 41 from the turbine exhaust flowing in a longitudinal direction along axis LA within the header. The steam may enter on end of the contiguous steam header formed from the multiple cooling cells fluidly coupled together at by the steam and condensate headers. The steam cascades along the steam header 41 and flows downwards into the steam flow plenum 80 beneath the header. From the plenum 80, the steam then enters to open top end of each tube 44 in each opposing pair of first and second tube bundles 43 in each cooling cell. The steam condenses and transitions from the vaporous water state to the liquid state ("condensate") as it progressively flows downward inside the tubes. The condensing steam actually may create a partial vacuum region within the tubes, which helps draw steam into the tubes. The heat liberated from the steam is rejected to ambient cooling air blown through the tube bundles 43 by fan 50, which forms the heat sink. The condensate flows into the condensate flow plenums 90 exiting the open bottom ends of the tubes in each bundle. The condensate is collected from the plenums 90 by the condensate headers 42 at the bottom and flows back to the Rankine cycle flow loop 20 previously described herein with respect to FIG. 1.

In one aspect of the invention, a thermal expansion lock or restraint system 100 is provided which both: (1) limits the longitudinal/horizontal growth of the steam header 41 (and in turn associated angularly opposed upper tubesheets 70 and steam flow plenum 80); and (2) limits the vertical growth of the tube bundles 43. The restraint system thus provides a fixed point or expansion stop in the support structure for the pressure retaining components which is referred to herein as a dual purpose "Lock Point" design. The Lock Point design thus limits longitudinal movement or growth of the steam header initially at ambient temperatures in the direction of and parallel to longitudinal axis LA due to thermal expansion when heated by the inflow of higher temperature turbine exhaust steam. The Lock Point design further limits the vertical growth and movement of the tube bundles 43 under thermal expansion when initially heated by the steam flow. The thermal expansion restraint system is designed to allow a controlled degree of growth in the longitudinal direction and vertical direction, then stops the growth at stress levels in the component materials which will avoid cracking or mechanical failure.

In one embodiment, with reference to FIGS. 2, 10, and 13-20, the thermal expansion restraint system 100 with Lock Point design may comprise one or more thermal restraint units 101 each comprising a standalone structural A-frame 59 comprising mating pairs of angled beams 59-1. Beams 59-1 may be I-beams which extend from the vicinity of the upper tubesheets 70/steam flow plenum 80 down to the fan platform 45-1. The angled beams 59-1 may be rigidly and fixedly mounted at bottom to the fan platform 45-1 (e.g. deck plate 51 and/or longitudinal beams 47) via welded and/or bolted connections. The angled beams 59-1 are laterally spaced apart from the tube bundles and may be oriented generally parallel thereto in one embodiment (recognizing slight field installation tolerances).

At top, the beams 59-1 may be coupled together by a structural coupling assembly 59-2 defining an apex of the thermal restraint unit 101. The coupling assembly 59-2 may comprise a plurality of plates, stiffener plates, and gusset plates as shown welded and/or bolted together in a suitable configuration which rigidly secures the top ends of the beams 59-1 to the coupling assembly via bolted and/or welded connections. Any suitable arrangement of the structural elements in the coupling assembly 59-2 may be used to structurally lock and tie the angled beams 59-1 together in a manner which will resist a bending moment in the thermal restraint unit 101 created by the longitudinal growth of the steam header 41. The steam header generally produces the largest longitudinally acting thermal expansion forces which must be counteracted by the thermal restraint unit 101.

In one embodiment, both the vertical and longitudinal restraint features of the thermal expansion restraint system 100 are provided by a vertically oriented fixation member such as fixation keel plate 102 in one embodiment which serves both purposes. The dual duty keel plate 102 is slideably mounted to the top coupling assembly 59-1 of A-frame 59 for limited unidirectional sliding movement in the vertical direction only. However, keel plate 102 is fixed axially in position (horizontal direction) along the longitudinal axis LA to restraint the thermal growth of the steam header 41. This arrangement and dual functionality may be achieved as explained below in one embodiment.

Referring to FIGS. 13-20, keel plate 102 is coupled to and protrudes upwards from and above the structural coupling assembly 59-2. Keel plate 102 may be T-shaped plate in one non-limiting design comprising a horizontal flange 102-1 and vertical flange 102-2 in one embodiment. In one embodiment, keel plate 102 may be a short section of a T-shaped structural beam oriented horizontally. Other shape and types of conventional structural members may be used for keel plate 102 in other embodiments. Vertical flange 102-2 is received between a pair of vertical upstanding guide plates 120 fixedly attached to the coupling assembly 59-2 of the rigid stationary A-frame 59. Guide plates 120 thus also remain stationary when the ACC 40 is heated by steam and do not undergo an substantial thermal expansion caused by direct with the flowing steam.

The combination and sandwiched arrangement of the vertically slideable keel plate 102 and stationary guide plates 120 are configured to provide a vertical expansion joint operable to arrest upwards expansion/growth of the tube bundles 43 affixed to the angled pair of upper tubesheets 70 after providing limited vertical movement. The guide plates 120 include a plurality of guide holes 123 each of which are aligned with a respective mating vertical guide slot 121 formed in the vertical flange 102-2 of keel plate 102. A guide bolt 122 is inserted through each of the mating slots and holes and secured thereto. In one non-limiting example as illustrated, keel plate 102 may include three guide slots 121 recognizing that more or less guide slots may be provided. The purpose of the vertical slots 121 in the keel plate is to allow the tube bundles 43 to grow a limited degree in the vertically direction. The slots 121 provide the vertical expansion stop of the thermal expansion restraint system 100 to limit further vertical tube bundle 43 expansion (noting that the bundles are actually angled in orientation).

Keel plate 102 is seal welded on each side to the angled upper tubesheets 70 for the entire length of the keel plate. In one construction, each opposite longitudinal edge of the horizontal flange 102-1 of the keel plate may be welded to the upper tubesheets 70 via fillet seal welds 102-3 (see, e.g. FIG. 18). This maintains the leak proof construction of the steam flow plenum 80. Notably, this physically locks the keel plate 102 to the upper tubesheets 70 such that the keel plate will move vertically upwards in unison with the tubesheets when the tube bundles 43 grow in length vertically upwards when heated by steam.

The slideable coupling assembly described above between the fixed/stationary guide plates 120 on the A-frame 59 and the keel plate provided by vertical slots 121 in the keel plate allows limited vertical movement of both the keel plate and tube bundles commensurate with the length of the slots. As the tube bundles 43 grow and the rigidly joined assembly of the upper tubesheets 70 and keel plate 102 move upward under thermal expansion, the keel plate will slide upwards along the guide bolts 122 until the bolts bottom out in the slots. Further vertically movement of tube bundles, tubesheets, and keel plate is thus arrested. This represents the vertical restraint feature or expansion stop.

The longitudinal restraint feature or expansion stop also involves the keel plate 102 as well, as alluded to above. Keel plate 102 represents a longitudinally stationary part of the thermal restraint unit 101 which is fixed in longitudinal/horizontal position along the longitudinal axis LA via the guide assembly of vertical guide slots 121, guide bolts 122, and guide holes 123 in the guide plates 120. The vertical slots of course do not permit longitudinal/horizontal movement of the keel plate 102 relative to the stationary guide plates 120 on the structural coupling assembly 59-2 of the A-frame 59, thereby fixedly mounting the keel plate to the structural A-frame 59 of thermal restraint unit 101 in axial position along the longitudinal axis. Because the upper tubesheets 70 are fixedly coupled to the steam flow plenum 80, which in turn is fixedly coupled to the steam header 41, the fixation keel plate 102 which is fixedly welded to upper tubesheets 70 locks the steam header in axial position along the longitudinal axis LA. Since the thermal restraint unit 101 is unaffected by whether the ACC is in the hot operating condition receiving steam or cold shutdown condition, the keel beam 102 will always maintain the same axial (longitudinal) position as the A-frame 59 which is rigidly mounted to the fan platform.

To prevent interaction of the fixation keel plate 102 with the steam flow plenum 80, the keel plate protrudes upwards from coupling assembly 59-2 into a downwardly open receptacle 103 formed in a boxed-out portion at the bottom of steam flow plenum. The top keel plate horizontal flange 102-1 may be disposed inside the receptacle along with the upper portion of vertical flange 102-2. The boxed-out portion of the steam flow plenum 80 may be formed by a polygonal shaped seal box 107 comprising a pair of laterally/transversely spaced apart longitudinal sidewalls 104, an opposing pair of end walls 105, and a top wall 106 extending between the sidewalls and end walls which closes the top of the box. The sidewalls, end walls, and top wall of seal box 107 are sealed welded together, and in turn the seal box is seal welded to the seal plate 83 and each of the upper tubesheets 70 forming a fluid-tight sealed receptacle 103. The seal plate 83, in specific, may be welded to the exterior surface of each end wall 105 of the seal box.

The end walls 105 of seal box 107 define a pair of opposing interior surfaces 109 vertically oriented and facing inwards towards the receptacle 103. The ends of the keel plates 102 define corresponding end surfaces 108 which remain spaced apart from the interior surfaces 108 of end walls 105 which the seal box 107 moves longitudinally with the steam header 41 under thermal expansion when the ACC 40 is heated by receiving steam.

In operation of the thermal expansion restraint system 100 with respect to longitudinal growth of the steam header 41, the fixation keel plate 102 does not come into any or at least substantial contact with the seal box 107 (i.e. sidewalls, end walls, or top wall) within the receptacle 103 when the pressure retention components described above are in their cold condition in the absence of steam flow to the ACC (i.e. not subjected to thermal expansion). In the cold condition, the seal box end walls 105 are longitudinally spaced apart from the keel plate end surfaces 108 (see, e.g. FIG. 16). When steam flow is initiated through and heats the steam header 41, steam flow plenum 80, and upper tubesheets 70 during normal operation of the ACC, these flow components will grow longitudinally due to thermal expansion of these metal components. This causes the tube structure to grow and expand longitudinally in length. This expansion causes the seal box 107 with end walls 105 to move and shift in longitudinal axial position relative to the keel plate 102 of the thermal restraint. However, the keel plate 102 restrains and locks the upper tubesheet 70 and steam header 41 coupled thereto in axial position along the longitudinal axis LA. This prevents the stationary keel plate end surface 108 from engaging the interior surfaces 109 of the seal box end walls 105, thereby maintaining a spaced apart relationship. Seal box 107 has a sufficient length to prevent engagement with the fixation keel plate 102 when the steam header 41 is either in a linear contracted cold or expanded hot position.

In a preferred embodiment, it is significant to note that the A-frame 59 of thermal restraint unit 101 is a self-supporting and free-standing structure which does not engage any structure or pressure retention component above the fan deck plate 51 where the A-frame is fixedly mounted to the fan support frame 45. Accordingly, the A-frame 59 comprising the angled beams 59-1 and coupling assembly 59-2 of each thermal restraint unit 101 are unconnected to and do not engage any portion of the tube bundles 43, upper and lower tubesheets 70, 71, steam and condensate headers 41, 42, or steam and condensate flow plenums 80, 90 either directly or indirectly via intermediate structural elements. Particularly, it bears noting that tube bundles 43 receive no support whatsoever from the angled beams 59-1 and are spatially separated therefrom by a physical gap G1 (see, e.g. FIGS. 10 and 14). Each thermal restraint unit 101 is therefore structurally a standalone and independent structure for thermal expansion restraint purposes only in the preferred embodiment which is nested inside and beneath the tube bundles 43 and headers 41, 42 as shown. Accordingly, the tube bundles 43 and headers 41, 42 form parts of an A-shaped "tube structure" which is independently self-supporting from the thermal restraint A-frame 59 such that the tube bundles are unsupported by the angled beams 59-1, or any portion of the fan support frame 45 between the upper and lower tubesheets 70, 71 above the fan deck plate 51.

A plurality of thermal restraint units 101 may be provided for each cooling cell (which comprises the components shown in FIG. 2 et al.). For example, in the non-limiting illustrated embodiment, a pair of thermal restraint units 101 may be provided. The units may be closely spaced apart and proximate to each other and share a common axially elongated receptacle 103 into which keel plates 102 from each thermal restraint unit 101 is received (best shown in FIG. 16). For a series of cooling cells or units each comprising an assembly of steam headers 41, condensate header 42, and tube bundles 43 generally shown in FIG. 2, a single Lock Point thermal expansion restraint system 100 may be provided preferably towards the center of the longitudinally-extending trains of cooling cells with axially and fluidly interconnected steam headers 41 joined together in a contiguous concatenated or series fashion. This causes the steam headers to grow in two opposing directions from the Lock Point once the longitudinal growth of the steam header has been arrested by the thermal expansion restraint system 100. This type of bi-directional thermal expansion control arrangement is preferred over allowing a completely unrestrained and long steam contiguous header assembly to simply grow in a single direction over a significantly greater length at the free end.

Other arrangements and spacings of thermal restraint units may be provided in other implementations.

According to another aspect, the ACC 40 may also include a longitudinally-extending overhead trolley monorail 55 which provides support for a wheeled trolley hoist (not shown) to facilitate maintenance on the fan for lifting and maneuvering the motor and gear box. Monorail 55 is spaced and mounted above the fan 50 as shown. In one embodiment, the monorail 55 may be suspended overhead and supported by a plurality of vertical support hangers 58 spaced intermittently along the monorail. In one embodiment, the hangers 58 may comprises structural angles attached to the angle seal plate 83 at top and monorail 55 at bottom such as via welding or bolted connections.

The headers, tubes and fins, flow plenums, fan platform and its support frame, saddle supports, monorail and its support system, and other fluid related or structural members described herein may preferably be made of an appropriate metallic materials suitable for the service conditions encountered.

While the foregoing description and drawings represent preferred or exemplary embodiments of the present invention, it will be understood that various additions, modifications and substitutions may be made therein without departing from the spirit and scope and range of equivalents of the accompanying claims. In particular, it will be clear to those skilled in the art that the present invention may be embodied in other forms, structures, arrangements, proportions, sizes, and with other elements, materials, and components, without departing from the spirit or essential characteristics thereof. In addition, numerous variations in the methods/processes as applicable described herein may be made without departing from the spirit of the invention. One skilled in the art will further appreciate that the invention may be used with many modifications of structure, arrangement, proportions, sizes, materials, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims and equivalents thereof, and not limited to the foregoing description or embodiments. Rather, the appended claims should be construed broadly, to include other variants and embodiments of the invention, which may be made by those skilled in the art without departing from the scope and range of equivalents of the invention.

What is claimed is:

1. An air-cooled condenser comprising:

a longitudinal axis;

a longitudinally-extending steam header configured for receiving steam from a source of steam;

a pair of longitudinally-extending circular condensate headers positioned below the steam header and spaced laterally apart;

a pair of inclined tube bundles each comprising a plurality of tubes connected to an upper tubesheet fixedly coupled to a longitudinally-extending steam flow plenum fixedly coupled to the steam header, and a lower tubesheet, the tube bundles disposed at an acute angle to each other;

each tube bundle extending between and fluidly coupled to the steam header at top and a different one of the condensate headers at bottom forming an A-shaped tube structure;

a standalone thermal restraint unit comprising an A-frame including a pair of acutely angled beams fixedly mounted to a fan platform at bottom and an upper structural coupling assembly at an apex, the angled beams spaced apart from the tube bundles and arranged generally parallel thereto;

the thermal restraint unit further comprising a vertically oriented fixation keel plate slideably mounted to the upper structural coupling assembly at the apex for limited vertical movement, the fixation keel plate fixedly seal welded to each of the upper tubesheets and operable to arrest thermal growth of the tube bundles in a vertical direction when the air-cooled condenser is heated by steam;

a fan mounted to a fan support frame and positioned below the tube bundles, the fan support frame supporting the fan platform;

wherein the tube structure is self-supporting such that the tube bundles are unsupported by the fan support frame between the upper and lower tubesheets.

2. The air-cooled condenser according to claim 1, wherein the condensate headers comprise piping sections which are slideably mounted to the fan support frame for axial sliding movement.

3. The air-cooled condenser according to claim 2, wherein the condensate headers are each slideably supported by a saddle support fixedly attached to the frame, the saddle supports comprising an upwardly open arcuately curved support surface which slideably engages the condensate headers.

4. The air-cooled condenser according to claim 3, further comprising an anti-friction coating applied to the support surfaces to facilitate sliding engagement between the condensate headers and the support surfaces.

5. The air-cooled condenser according to claim 4, further comprising a semi-circular wear plate may be rigidly attached to a bottom half of the condensate headers, the wear plate slideably engaging the anti-friction coating on the support surface.

6. The air-cooled condenser according to claim 2, wherein each of tube bundles is supported by the condensate headers alone without direct support from any part of the fan support frame.

7. The air-cooled condenser according to claim 1, further comprising:

a top steam flow plenum fluidly coupled between the steam header and the tube bundles, the upper tubesheets of each tube bundle attached to the steam flow plenum which is configured to transfer steam from the steam header to the tube bundles;

a condensate flow plenum fluidly coupled between each condensate header and a respective one of the tube bundles, the lower tubesheet of each tube bundle attached to a respective one of the condensate flow plenums which is configured to transfer condensate from the tube bundles to the condensate headers.

8. The air-cooled condenser according to claim 7, wherein the top steam flow plenum is fluidly coupled directly to a bottom of the steam header and has a pentagon shape in transverse cross section.

9. The air-cooled condenser according to claim 7, wherein the top steam flow plenum comprises an opposing pair of longitudinally-extending side skirt plates seal welded between the steam header and the upper tubesheets of each tube bundle to fluidly seal the steam flow plenum.

10. The air-cooled condenser according to claim 1, wherein the upper tubesheets are hingedly connected together by a longitudinally-extending angled seal plate constructed to form a fluid tight seal between the upper tubesheets, the seal plate is monolithic in structure and comprising a resiliently flexible angled metal body operable to expand and contract due to thermal expansion.

11. The air-cooled condenser according to claim 10, wherein the upper tubesheets of the tube bundles are arranged at an obtuse angle to each other and separated by a longitudinally-extending gap; and the gap being bridged by the seal plate having opposing longitudinal edges each seal welded to one of the upper tubesheets to form a fluidly sealed interface therebetween.

12. The air-cooled condenser according to claim 11, wherein the seal plate is a metal angle having an obtusely angled configuration in transverse cross section.

13. The air-cooled condenser according to claim 1, wherein the tubes are finned and the tube bundles each comprise a linear row of single tubes in side-to-side relation.

14. The air-cooled condenser according to claim 1, further comprising the A-frame being fixedly mounted to the fan support frame and spaced apart from the tube bundles, and the vertically oriented fixation keel plate also being configured and operable to restrain the upper tubesheets from thermal growth and movement in a horizontal direction along the longitudinal axis.

15. The air-cooled condenser according to claim 14, wherein the vertically oriented keel plate projects upwardly from an apex of the thermal restraint unit, the keel plate received in a downwardly open receptacle of a seal box attached between the upper tubesheets.

16. The air-cooled condenser according to claim 15, wherein the keel plate is coupled to the A-frame by a sliding expansion joint formed between the keel plate and the A-frame, wherein the keel plate is movable vertically upwards with the upper tubesheets when the tube bundles grow due to thermal expansion.

17. The air-cooled condenser according to claim 16, wherein the sliding expansion joint comprises a vertical slot in the keel plate which slideably receives a guide bolt fixedly mounted to the thermal restraint unit, the slot operable to limit the vertical movement of the keel plate.

18. An air-cooled condenser comprising:

a longitudinal axis;

a longitudinally-extending steam header configured for receiving steam from a source of steam;

a pair of longitudinally-extending condensate headers positioned below the steam header and spaced laterally apart, the steam and condensate headers oriented parallel to each other;

a pair of inclined tube bundles each comprising a plurality of tubes connected to an upper tubesheet fixedly coupled to a longitudinally-extending steam flow plenum fixedly coupled to the steam header, and a lower tubesheet, the tube bundles disposed at an acute angle to each other;

the upper tubesheets being hingedly and sealably connected together by a longitudinally-extending angled seal plate forming a fluid tight coupling therebetween, the seal plate comprising a resiliently flexible metal body operable to deform under thermal expansion or contraction;

each tube bundle arranged between and in fluid communication with the steam header and a different one of the condensate headers at bottom;

a fan arranged for blowing ambient cooling air upwards through the bundles;

a fan platform configured to support and raise the fan above a support surface, the fan platform comprising a horizontal fan deck positioned below the tube bundles;

a standalone thermal restraint unit comprising an A-frame including a pair of acutely angled beams fixedly mounted to the fan platform at bottom and an upper structural coupling assembly at an apex, the angled beams spaced apart from the tube bundles and arranged generally parallel thereto;

the thermal restraint unit further comprising a vertically oriented fixation keel plate slideably mounted to the upper structural coupling assembly at the apex for limited vertical movement, the fixation keel plate fixedly seal welded to each of the upper tubesheets and operable to arrest thermal growth of the tube bundles in a vertical direction when the air-cooled condenser is heated by steam.

19. The air-cooled condenser according to claim 18, further comprising a longitudinally-extending hoist monorail positioned above the fan, the monorail suspended overhead from the seal plate.

20. The air-cooled condenser according to claim 18, wherein the condensate headers are slideably mounted to the fan platform for axial sliding movement due to thermal expansion or contraction.

21. The air-cooled condenser according to claim 20, wherein the condensate headers are each slideably supported by a saddle support fixedly attached to the fan platform, the saddle supports comprising an upwardly open arcuately curved support surface which slideably engages the condensate headers.

22. The air-cooled condenser according to claim 18, further comprising:

a top steam flow plenum fluidly coupled between the steam header and the tube bundles, the upper tubesheets of each tube bundle attached to the steam flow plenum which is configured to transfer steam from the steam header to the tube bundles;

a condensate flow plenum fluidly coupled between each condensate header and a respective one of the tube bundles, the lower tubesheet of each tube bundle attached to a respective one of the condensate flow plenums which is configured to transfer condensate from the tube bundles to the condensate headers.

23. The air-cooled condenser according to claim 22, wherein steam flow plenum is fluidly coupled directly to a bottom of the steam header and has a pentagon shape in transverse cross section.

24. The air-cooled condenser according to claim 23, wherein the steam flow plenum comprises an opposing pair of longitudinally-extending side skirt plates seal welded between the steam header and the upper tubesheets of each tube bundle to form a fluidly sealed steam flow plenum.

25. An air-cooled condenser comprising:

a longitudinal axis;

a longitudinally-extending steam header configured for receiving steam from a source of steam;

a pair of longitudinally-extending circular condensate headers positioned below the steam header and spaced laterally apart;

a pair of inclined tube bundles each comprising a plurality of tubes connected to an upper tubesheet fixedly coupled to a longitudinally-extending steam flow plenum fixedly coupled to the steam header, and a lower tubesheet, the tube bundles disposed at an acute angle to each other;

each tube bundle extending between and fluidly coupled to the steam header at top and a different one of the condensate headers at bottom forming an A-shaped tube structure;

a standalone thermal restraint unit comprising an A-frame including a pair of acutely angled beams fixedly mounted to a fan platform at bottom and an upper structural coupling assembly at an apex, the angled beams spaced apart from the tube bundles and arranged generally parallel thereto;

the thermal restraint unit further comprising a vertically oriented fixation keel plate slideably mounted to the upper structural coupling assembly at the apex for limited vertical movement, the fixation keel plate fixedly seal welded to each of the upper tubesheets and operable to arrest thermal growth of the tube bundles in a vertical direction when the air-cooled condenser is heated by steam;

a fan support frame supporting a fan below the tube bundles, the fan support frame supporting the fan platform;

the condensate headers each axially slideably supported by a saddle support fixedly attached to the fan support frame, the saddle supports each comprising an upwardly open arcuately curved support surface of semi-circular configuration which slideably engages the condensate headers;

wherein the condensate headers are operable to expand or contract in length in a direction parallel to the longitudinal axis due to thermal expansion or contraction conditions.

26. The air-cooled condenser according to claim 25, wherein the tube structure is self-supporting such that the tube bundles are unsupported by the fan support frame between the upper and lower tubesheets.

27. The air-cooled condenser according to claim 25, wherein the upper tubesheets are hingedly connected together by a longitudinally-extending seal plate, the seal plate comprising a resiliently flexible monolithic metal body operable to deform under thermal expansion or contraction.

28. The air-cooled condenser according to claim 18, wherein the keel plate is horizontally fixed in position relative to the upper structural coupling assembly, the keel plate being operable to restrain thermal growth of the steam header in an axial direction along the longitudinal axis.

* * * * *